US009344801B2

(12) United States Patent
Yoo et al.

(10) Patent No.: US 9,344,801 B2
(45) Date of Patent: May 17, 2016

(54) HEADSET

(71) Applicant: LG ELECTRONICS INC., Seoul (KR)

(72) Inventors: Hyunsun Yoo, Seoul (KR); Myunghyun Park, Seoul (KR); Jaeyoung Kim, Seoul (KR); Hyungwoo Park, Seoul (KR); Sangwoo Seo, Seoul (KR); Kunwoo Lee, Seoul (KR); Secheol Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1 day.

(21) Appl. No.: 14/553,551

(22) Filed: Nov. 25, 2014

(65) Prior Publication Data

US 2016/0073200 A1 Mar. 10, 2016

(30) Foreign Application Priority Data

Sep. 4, 2014 (KR) ..... 10-2014-0117390

(51) Int. Cl.
*H04R 1/10* (2006.01)
*H04R 5/033* (2006.01)

(52) U.S. Cl.
CPC ..... *H04R 5/0335* (2013.01); *H04R 1/10* (2013.01); *H04R 2420/07* (2013.01)

(58) Field of Classification Search
None
See application file for complete search history.

(56) References Cited

U.S. PATENT DOCUMENTS

| | | | | | |
|---|---|---|---|---|---|
| 5,046,192 | A * | 9/1991 | Ryder | A61F 9/045 | 2/12 |
| 5,438,698 | A * | 8/1995 | Burton | H01Q 1/276 | 2/209.13 |
| 5,457,751 | A * | 10/1995 | Such | H04M 1/05 | 348/115 |
| 5,790,681 | A * | 8/1998 | Leppalahti | A42B 3/30 | 2/906 |
| 5,881,390 | A * | 3/1999 | Young | A41D 20/00 | 2/209.13 |
| 6,301,367 | B1 * | 10/2001 | Boyden | A42B 1/245 | 2/209 |
| 6,546,264 | B1 * | 4/2003 | Kennedy | A42B 3/30 | 379/430 |
| 2002/0131616 | A1 * | 9/2002 | Bronnikov | A42B 1/245 | 381/370 |
| 2004/0204207 | A1 | 10/2004 | Parker | | |
| 2007/0003092 | A1 * | 1/2007 | Shen | A42B 1/068 | 381/374 |

(Continued)

FOREIGN PATENT DOCUMENTS

| | | |
|---|---|---|
| JP | 2010-124339 | 6/2010 |
| JP | 2012-070245 | 4/2012 |
| KR | 10-2005-0090690 | 9/2005 |

OTHER PUBLICATIONS

PCT International Application No. PCT/KR2014/010463, Written Opinion of the International Searching Authority dated May 29, 2015, 3 pages.

(Continued)

*Primary Examiner* — Brenda Bernardi
(74) *Attorney, Agent, or Firm* — Lee, Hong, Degerman, Kang & Waimey; Jonathan Kang; Harry Lee

(57) ABSTRACT

A headset is provided. The headset includes: a hook hung on a user's neck; a pair of sound output units connected to both end parts of the hook; and a clipping module provided to at least one sound output unit and coupled to a cap worn by the user to allow the at least one sound output unit to be detachable.

34 Claims, 35 Drawing Sheets

(56) References Cited

U.S. PATENT DOCUMENTS

2007/0104345 A1* 5/2007 Yang ..... H04R 1/1066 381/381
2008/0144872 A1* 6/2008 Phillips ..... H04R 5/0335 381/333
2009/0123000 A1* 5/2009 Wright ..... H04R 1/105 381/59
2009/0175482 A1* 7/2009 Crutcher ..... A42B 1/245 381/376
2009/0257615 A1* 10/2009 Bayer, Jr. ..... H04R 1/1066 381/376
2011/0007928 A1 1/2011 Chang
2013/0064411 A1 3/2013 Alstad
2014/0047616 A1* 2/2014 Lee ..... A42B 1/245 2/209.13
2014/0301595 A1* 10/2014 Egleston ..... H04R 1/02 381/388
2014/0328508 A1* 11/2014 Jacks ..... H04R 1/1008 381/376
2014/0355807 A1* 12/2014 McDowell ..... H04R 1/02 381/334
2014/0369544 A1* 12/2014 Flynn ..... H04R 1/105 381/376
2015/0222974 A1* 8/2015 Johnson ..... H04R 1/028 381/388

OTHER PUBLICATIONS

Korean Intellectual Property Office Application Serial No. 10-2014-0117390, Notice of Allowance dated Oct. 30, 2015, 2 pages.

* cited by examiner

HEADSET

CROSS-REFERENCE TO RELATED APPLICATIONS

Pursuant to 35 U.S.C. §119(a), this application claims the benefit of earlier filing date and right of priority to Korean Patent Application No. 10-2014-0117390, filed on Sep. 4, 2014, the contents of which are all hereby incorporated by reference herein in its entirety.

BACKGROUND

The present disclosure relates to a headset.

In general, a headset refers to a sound output device that a user mounts on the head in order to listen to music.

Recently, a wireless headset including a short range wireless communication module with Bluetooth receives attention. Newly, a headset is mounted on a cap and is released as a product.

However, in the case of a cap-mounted headset that is currently on the market, since a headset is fixedly attached to a cap, it is difficult to separate them. Moreover, since the headset is not separated from the cap, it is inconvenient to wash the cap.

Additionally, in the case of a cap only Bluetooth headset, it is impossible to listen to music if a user takes off a cap. Thus, a user needs to connect an additional earphone to a smartphone or a music player.

Moreover, since a headset is coupled to a cap, it is very inconvenient for a user when charging the headset.

SUMMARY

Embodiments provide a headset for resolving the above-mentioned issues.

In one embodiment, a headset includes: a hook hung on a user's neck; a pair of sound output units connected to both end parts of the hook; and a clipping module provided to at least one of the sound output units, the clipping module configured to allow the at least one sound output unit to be detachably coupled to a cap worn by the user, wherein each of the sound output units comprises: a case; a frame surrounding an outer peripheral surface of the case and including a first speaker hole formed at an edge portion; and a speaker module installed inside the case, wherein the clipping module comprises: a guide sleeve extending from an inside of the case; a plurality of hook shoulders extending in a length direction of the guide sleeve at an inner peripheral surface of the guide sleeve and arranged in a circumferential direction of the guide sleeve; a fixing clip disposed at an inner surface of the case facing the user's ear; a clip button penetrating the fixing clip to be inserted into the guide sleeve and moving with the fixing clip integrally to allow the fixing clip to be selectively in close contact the inner surface of the case; a stopper selectively hooked by the hook shoulder and pushing the clip button when separated from the hook shoulder; and a spring in close contact one surface of the stopper and having an elastic force for pushing the stopper.

The clip button may include: a head part including a second speaker hole; a hollow body part extending from the other surface of the head part and having a narrower diameter as it approaches an end part; a plurality of push protrusions protruding from the end part of the body part and arranged spaced a predetermined interval from each other in a circumferential direction of the body part; and a plurality of guide protrusions protruding from an outer peripheral surface of the body part and arranged spaced a predetermined interval from each other in the circumferential direction of the body part.

The plurality of guide projections may be formed at points corresponding to the plurality of push protrusions; and a center of the plurality of guide protrusions and a center of the push protrusions may be disposed on the same line.

The guide sleeve may extend from an inner surface of the case, wherein the guide sleeve may further include: a sitting projection extending in a center direction of the guide sleeve from a bottom surface of the guide sleeve; and a plurality of guide ribs protruding from an inner peripheral surface of the guide sleeve, extending in a length direction of the guide sleeve, and arranged spaced a predetermined interval from each other in a circumferential direction of the guide sleeve.

Guide grooves may be formed between the adjacent guide ribs; and the guide protrusions may be inserted into the guide grooves to guide a movement of the clip button.

The hook shoulder may be formed between the adjacent guide ribs; and the guide groove and the hook shoulder may be alternately formed in the circumferential direction of the guide sleeve.

An inclined surface inclined at a predetermined angle may be defined at an end part of the guide rib; and the hook shoulder may be inclined to be disposed on the same line as the inclined surface of the guide rib.

The stopper may include: a base having one surface where the spring is seated; a stopper body extending from the other surface of the base; and a plurality of hook protrusions protruding from an outer peripheral surface of the stopper body in a circumferential direction and moving along the guide groove.

Each of the plurality of hook protrusions may form a push surface selectively contacting the push protrusion; and the push surface may be inclined at an angle to match a shape of the inclined surface of the guide rib and the hook shoulder.

When the clip button is pushed, the hook protrusion may be pushed by the push protrusion and moves along the guide groove; the spring may be compressed; and when a force for pushing the clip button is removed at a point where the hook protrusion is out of the guide groove, the hook protrusion may rotate along the inclined surface of the guide rib by the restoring force of the spring and is seated on the hook shoulder.

The clip button may be recessed to a point where the hook shoulder is seated on the hook shoulder; and the clip button may be fixed by a frictional force between the outer peripheral surface of the clip button and the sitting projection at a point where the hook protrusion is seated at the hook shoulder.

When the clip button is pushed again, the hook protrusion may be pushed by the push protrusion and separated from the sitting projection; the spring may be compressed; when a force for pushing the clip button is removed at a point where the hook protrusion is out of the guide rib, the hook protrusion may rotate along the inclined surface of the guide rib by the restoring force of the spring and is inserted into the guide groove; and the clip button may move as pushed by the hook protrusion and may be recessed until the guide protrusion contacts the sitting projection.

The elastic force of the spring may be greater than a frictional force between the outer peripheral surface of the clip button and the sitting projection.

The sound output unit may rotate at a predetermined angle from the hook and may be withdrawn in a direction away from the end part of the hook.

The sound output unit may rotate from a first position where the second speaker holes stand to face each other to a second position where the second speaker holes face the same direction or may inversely rotate from the second position to the first position.

A rotation angle from the first position to the second position may be 90°.

The sound output unit may include: a connecting neck extending from an edge of the frame; and a plurality of insertion protrusions protruding from an end part of the connecting neck, wherein the plurality of insertion protrusions may be arranged spaced at a predetermined angle from each other in a circumferential direction of the connecting neck.

The hook may include: a center hole formed at an inner center; and a plurality of insertion holes extending from an edge of the center hole radially and including a plurality of insertion holes respectively inserted to the plurality of insertion protrusions, wherein the plurality of insertion holes may be arranged spaced at a predetermined angle from each other in a circumferential direction of the center hole.

The number of the plurality of insertion protrusions may be less than the number of the plurality of insertion holes.

The headset may further include: an elastic member inserted into the hook through the center hole and having both end parts connected to the sound output unit; and a flexible substrate inserted into the hook through the center hole and having an end part electrically connected to a circuit component installed in the sound output unit.

When the plurality of insertion protrusions are inserted into the plurality of insertion holes, an end part of the connecting neck may adhere to an end part of the hook; when the sound output unit is pulled in a direction in which the end part of the connecting neck is separated from the end part of the hook, the flexible substrate and the elastic member may extend a predetermined length; and the plurality of insertion protrusions may be separated from the plurality of insertion holes.

After the sound output unit is rotated while the plurality of insertion protrusions are separated from the plurality of insertion holes, as a force for pulling the sound output unit is removed, the plurality of insertion protrusions may be inserted into other insertions holes adjacent to previously inserted insertion holes and the flexible substrate and the elastic member may return to their original positions.

Sound oriented directions of the first speaker hole and the second speaker hole may intersect each other.

Sound oriented directions of the first speaker hole and the second speaker hole may intersect at 90°.

The headset may further include a sensor module mounted at an inner one surface of the sound output unit to detect whether the sound output unit is mounted on a user's cap or whether the sound output unit is positioned close to a user's ear, wherein the sensor module may include an infrared sensor.

When it is detected by the sensor module that the sound output unit is mounted at the user's cap or is positioned close to the user's ear, a volume of the speaker module may be lowered to a setting level.

The headset may further include: a circuit substrate where the speaker module and the sensor module are mounted; and a battery mounted in the sound output unit.

The headset may further include: a cover plate mounted on an outer surface of the case to cover the circuit substrate; and a button part formed at an outer surface of the cover plate.

The button part may include: a power button disposed at a center of the cover plate; and a sound adjustment button and a search button disposed in a circumferential direction at a point spaced from the power button.

The sound adjustment button may include: a volume up button disposed at an upper part of the cover plate; and a volume down button disposed at a lower part of the cover plate, wherein the search button may include: a forward search button disposed at a front of the cover plate; and a backward search button disposed at a rear of the cover plate.

The headset may further include: a gyro sensor mounted in the sound output unit to detect a rotation state of the sound output unit, wherein whether the hook is changed from one position among a rear of user's head or a front of a cap to another position may be detected by the gyro sensor; and when a rotation of the sound output unit is detected by the gyro sensor, functions of the sound adjustment buttons and functions of the search buttons may be respectively inverted.

The headset may further include a short range wireless communication module mounted in the sound output unit and including a Bluetooth module.

When it is detected by the sensor module that the sound output unit is mounted on the user's cap, a radio frequency that a user listen most may be automatically selected and turned on.

When it is detected by the sensor module that the sound output unit is mounted in the user's cap, a cap dedicated sound equalizer may be set.

The details of one or more embodiments are set forth in the accompanying drawings and the description below. Other features will be apparent from the description and drawings, and from the claims.

DETAILED DESCRIPTION OF THE EMBODIMENTS

Hereinafter, a headset according to an embodiment of the present invention will be described in more detail with reference to the drawings.

Figure 1:
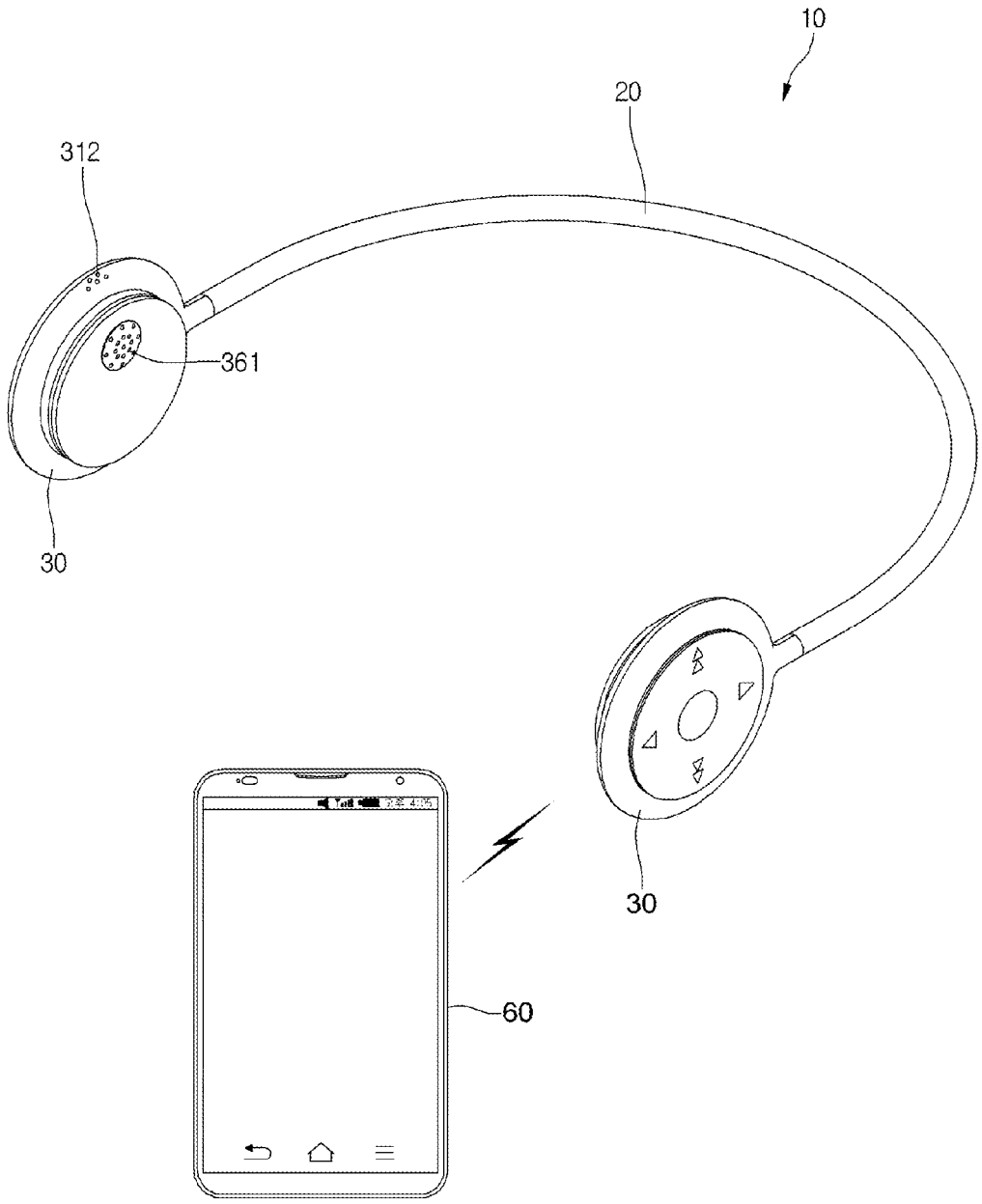
FIG. 1 is a wireless sound system including a headset and a mobile terminal allowing wireless communication with the headset according to an embodiment of the present invention.
Figure 1A:
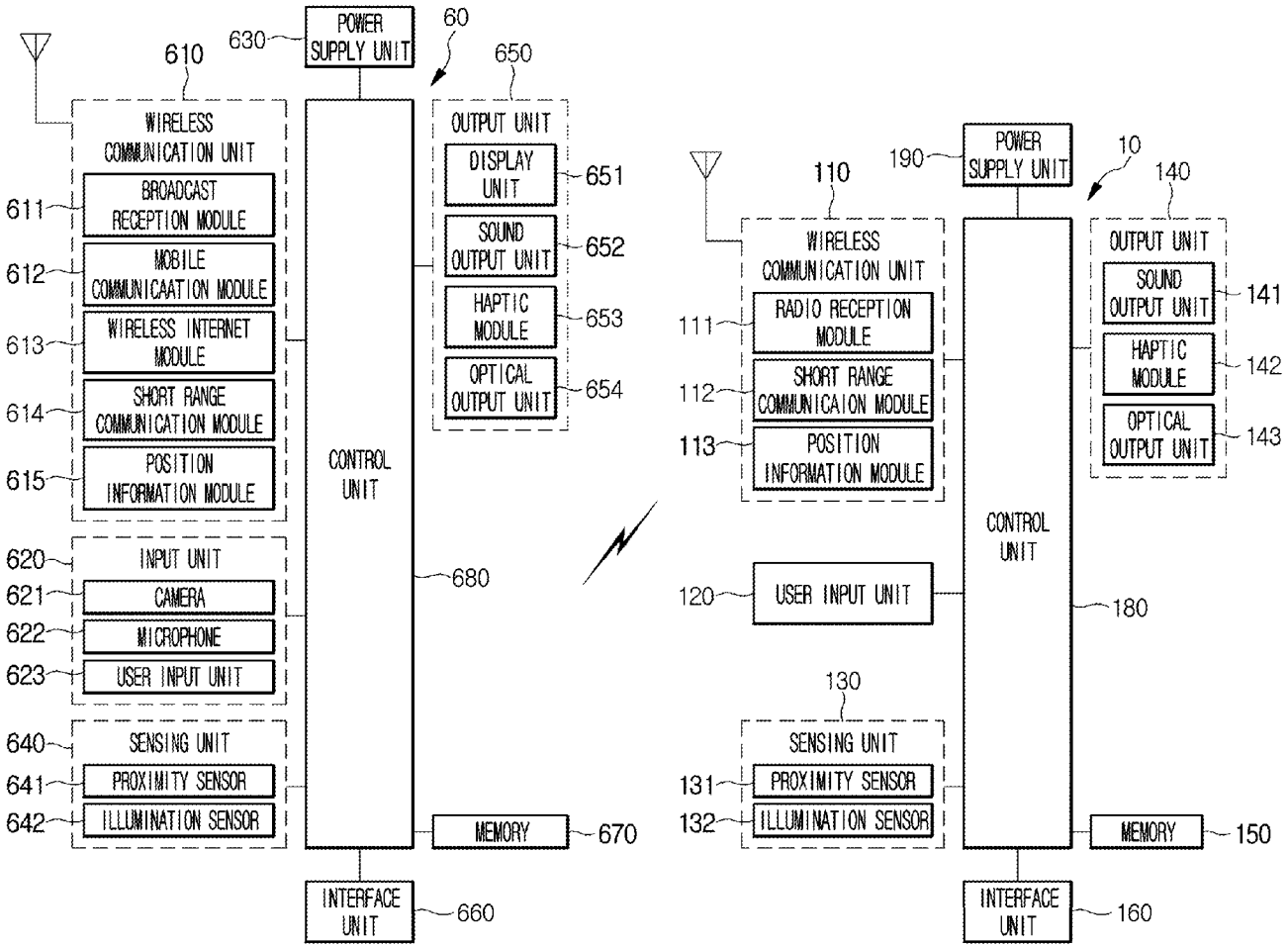
FIG. 1A is a block diagram illustrating a control configuration of the wireless sound system

FIG. 1 is a wireless sound system including a headset and a mobile terminal allowing wireless communication with the headset. FIG. 1A is a block diagram illustrating a control configuration of the wireless sound system.

Referring to FIGS. 1 and 1A, the wireless sound system includes a headset 10 and a mobile terminal 60 allowing wireless communication with the headset 10.

In more detail, the headset 10 is a sound device for wirelessly receiving and music or radio stations played in the mobile terminal 60 and allowing a user to listen to them while worn on the user's neck or head. The headset 10 includes an additional built-in radio reception module and thus is configured to allow a user to listen to the radio separately from the mobile terminal 60.

The headset 10 includes a flexible hook 20 and a pair of sound output units 30 connected to both ends of the hook 20.

In more detail, a main speaker hole 361 and a sub speaker hole 312 are formed at the different positions of the sound output unit 30 and the hook 20 is rotatably connected to the sound output unit 30.

Additionally, the mobile terminal 60 connected to the wireless 10 to allow wireless communication includes a wireless communication unit 610, an input 620, a detection unit 140, an output unit 650, an interface unit 660, a memory 670, a control unit 680, and a power supply unit 630.

In more detail, the wireless communication unit 610 may include at least one module for wireless communication between the mobile terminal 60 and a wireless communication system, between the mobile terminal 60 and another mobile terminal, or between the mobile terminal 60 and an external server.

Additionally, the wireless communication unit 610 may include at least one module connecting the mobile terminal 60 to at least one network. In more detail, the wireless communication unit 610 may include at least one a broadcast reception module 611, a mobile communication module 612, a wireless internet module 613, a short range communication module 614, and a position information module 615.

The input unit 620 may include a camera 621 or an image input unit for receiving an image signal input, a microphone 622 or an audio input unit for receiving an audio signal input, a user input unit 623 (for example, a touch key and a mechanical key) for receiving information from a user. The voice data or image data collected by the input unit 620 may be analyzed and then processed as a user's control command.

The sensing unit 640 may include at least one sensor for sensing at least one among information in a mobile terminal, information on an environment surrounding a mobile terminal, and user information.

For example, the sensing unit may include at least one among a proximity sensor (141), an illumination sensor (142), a touch sensor, an acceleration sensor, a magnetic sensor, a G-sensor, a gyroscope sensor, a motion sensor, an RGB sensor, an infrared (IR) sensor, a finger scan sensor, an ultrasonic sensor, an optical sensor (for example, a camera, a mike, and a battery gauge), an environmental sensor (for example, a barometer, a hygrometer, a thermometer, a radiation sensor, a thermal sensor, and a gas sensor), a chemical sensor (for example, an electronic noise, a healthcare sensor, and a biometric sensor). Moreover, a mobile terminal disclosed in this specification may combine and use information sensed by at least two sensors among such sensors.

The output unit 650 may include at least one display unit 650 for generating a visual, auditory, or tactile related output and may include at least one among a display unit 651, a sound output unit 652, a haptic module 653, and an optical output unit 654. The display unit 651 may form a mutual layer structure with a touch sensor or they may be integrally formed, thereby realizing a touch screen. Such a touch screen functions as the user input unit 623 providing an input interface between the mobile terminal 60 and a user and also functions as an output interface between the mobile terminal 60 and a user at the same time.

The interface unit 660 serves as a path to various kinds of external devices connected to the mobile terminal 60. The interface unit 660 may include at least one among a wired/wireless headset port, an external charger port, a wired/wireless data port, a memory card port, a port connecting a device equipped with an identification module such as the USIM card 130, an audio Input/Output (I/O) port, a video Input/Output (I/O) port, and an earphone port. In response to the interface unit 660 connected to an external device, the mobile terminal 60 may perform an appropriate control relating to the connected external device.

Additionally, the memory 670 stores data supporting various functions of the mobile terminal 60. The memory 670 may store a plurality of application programs or applications running on the mobile terminal 60, and data and commands for operations of the mobile terminal 60. At least part of such application programs may be downloaded from an external server through wireless communication. Additionally, at last part of such application programs may exist on the mobile terminal 60 from its factory in order for basic functions (for example, an incoming/outgoing call function and a message receiving/sending function) of the mobile terminal 60. Moreover, application programs are stored in the memory 670 and installed on the mobile terminal 60, and are executed to perform an operation (or a function) of the mobile terminal 60 through the control unit 680.

The control unit 680 controls overall operations of the mobile terminal 60 typically in addition to operations relating to the application program. The control unit 680 may provide or process information or functions proper for a user by processing signals, data, and information inputted/outputted through the above-mentioned components or application programs stored in the memory 670.

Additionally, the control unit 680 may control at least part of the components in order to execute the application program stored in the memory 670. Furthermore, the control unit 680 may combine and operate at least two of components in the mobile terminal 60 in order to execute the application program.

Under the control of the control unit 680, the power supply unit 630 receives external power or internal power and then supplies power to each component in the mobile terminal 60. The power supply unit 630 includes a battery and the battery may be a built-in battery or an interchangeable battery.

At least part of the components may co-operate each other in order to realize an operation, a control or a control method of a mobile terminal according to various embodiments described below. Additionally, the operation, the control, or the control method of the mobile terminal the control unit 680 may be realized by executing at least one application program stored in the memory 670.

Moreover, the broadcast reception module 611 of the wireless communication unit 610 receives broadcast signals and/or broadcast related information from an external broadcast server through a broadcast channel. The broadcast channel may include satellite channels and terrestrial channels. In order for simultaneous broadcast reception or broadcast channel switching for at least two broadcast channels, at least two radio reception modules may be provided to the mobile terminal 60.

The broadcast management service may mean a server generating and transmitting broadcast signals and/or broadcast related information or a server receiving pre-generated broadcast signals and/or broadcast related information and transmitting them to a terminal. The broadcast signals may include TV broadcast signals, radio broadcast signals, and data broadcast signals and also may include a combination of TV broadcast signals, radio broadcast signals, and data broadcast signals.

The broadcast signals may be encoded according to at least one among technical standards (or, broadcasting systems such as ISO, IEC, DVB, and ATSC) for transmitting/receiving digital broadcast signals.

The broadcast related information may mean information relating to broadcast channel, broadcast programs, or broadcast service providers. The broadcast related information may be provided through a mobile communication network. In such a case, the broadcast related information may be received by the mobile communication module 612.

The broadcast related information may be in various forms, for example, Electronic Program Guide (EPG) of Digital Multimedia Broadcasting (DMB) or Electronic Service Guide (ESG) of Digital Video Broadcast-Handheld (DVB-H). Broadcast signals and/or broadcast related information received through the broadcast reception module 611 may be stored in the memory 670.

The mobile communication module 612 may transmit/receive wireless signals to/from at least one among broadcast stations, external terminals, and servers on a mobile communication network established according to technical standards or communication systems for mobile communication (for example, Global System for Mobile communication (GSM), Code Division Multi Access (CDMA), Code Division Multi Access 2000 (CDMA2000), Enhanced Voice-Data Optimized or Enhanced Voice-Data Only (EV-DO), Wideband CDMA (WCDMA), High Speed Downlink Packet Access (HSDPA), High Speed Uplink Packet Access (HSUPA), Long Term Evolution (LTE), Long Term Evolution-Advanced (LTE-A), etc.)

The wireless signal may include various formats of data according to voice call signals, video call signals, or text/multimedia message transmissions.

The wireless internet module 613 refers to a module for wireless internet access and may be provided to the mobile terminal internally or externally. The wireless internet module 613 is configured to transmit/receive wireless signals on a communication network according to wireless internet techniques.

Wireless internet techniques include Wireless LAN (WLAN), Wireless-Fidelity (Wi-Fi), Wireless Fidelity (Wi-Fi) Direct, Digital Living Network Alliance (DLNA), Wireless Broadband (WiBro), World Interoperability for Microwave Access (WiMAX), High Speed Downlink Packet Access (HSDPA), High Speed Uplink Packet Access (HSUPA), Long Term Evolution (LTE), and Long Term Evolution-Advanced (LTE-A). The wireless internet module 113 transmits/receives data according to at least one wireless internet technique within a range including internet techniques not listed above.

In that wireless internet access through WiBro, HSDPA, HSUPA, GSM, CDMA, WCDMA, LTE, and LTE-A is made through a mobile communication network, the wireless internet module 613 performing the wireless internet access through the mobile communication network may be understood as a kind of the mobile communication module 612.

The short range communication module 614 is for short range communication and may support short range communication by using at least one among Bluetooth™, Radio Frequency Identification (RFID), infrared Data Association (IrDA), Ultra Wideband (UWB), ZigBee, Near Field Communication (NFC), Wireless-Fidelity (Wi-Fi), Wi-Fi Direct, Wireless Universal Serial Bus (Wireless USB) techniques. The short range communication unit 614 may support wireless communication through wireless area networks between the mobile terminal 60 and a wireless communication system, between the mobile terminal 60 and another mobile terminal, or between the mobile terminal 60 and a network where another terminal (or an external server) is located. The short range wireless communication network may be wireless personal area networks.

Herein, the other terminal 60 may be a wearable (or linkable) device exchanging data with the mobile terminal 60, for example, the headset 10, smartwatch, smart glass, and head mounted display (HMD). The short range communication module 614 may detect (or recognize) a wearable device communicating with the mobile terminal 60 around the mobile terminal 60. Furthermore, when the detected wearable device is a device authorized to communicate with the mobile terminal 60, the control unit 680 may transmit at least part of data processed in the mobile terminal 60 to the wearable device through the short range communication module 614. Accordingly, a user of a wearable device may use data processed in the mobile terminal 60 through a wearable device. For example, according to this, when the mobile terminal 60 receives a call, a user may receive the call through a wearable device or when the mobile terminal 60 receives a message, a user may check the message received through a wearable device.

The position information module 615 is a module for obtaining the position (or current position) of a mobile terminal and its representative examples include a Global Positioning System (GPS) module or a Wireless Fidelity (WiFi) module. For example, a mobile terminal may obtain its position through a GPS module by using a signal transmitted from a GPS satellite. As another example, a mobile terminal may obtain its position through a Wi-Fi module on the basis of information on a wireless access point (AP) transmitting/receiving wireless signals to/from the Wi-Fi module. If necessary, the position information module 615 may perform a function of another module of the wireless communication unit 610 in order to obtain data for the position of a mobile terminal substitutionally or additionally. The position information module 615 is a module used for obtain the position (or the current position) of a mobile terminal and is not limited to a module directly calculating or obtaining the position of a mobile terminal.

Then, the input unit 620 receives an input of image information (or signals), audio information (or signals), data, or information inputted from a user and the mobile terminal 60 may include one or a plurality of cameras 621. The camera 621 processes an image frame such as a still image or video obtained by an image sensor in a video call mode or a capturing mode. The processed image frame may be displayed on the display unit 651 or may be stored in the memory 670. Moreover, the plurality of cameras 621 equipped in the mobile terminal 60 may be disposed to form a matrix structure and through the camera 621 having such a matrix structure, a plurality of image information having various angles and focuses may be inputted to the mobile terminal 60. Additionally, the plurality of cameras 621 may be disposed in a stereo structure in order to obtain a left image and a right image for realizing a 3D image.

The microphone 622 processes external sound signals as electrical voice data. The processed voice data may be utilized diversely according to a function in execution (or an application program in execution) of the mobile terminal 60. Moreover, various noise removing algorithms for removing noise occurring while external sound signals are received may be realized in the microphone 622.

The user input unit 623 receives information from a user and once information is inputted through the user input unit 623, the control unit 680 may control an operation of the mobile terminal 60 in response to the inputted information. The user input unit 123 may include a mechanical input means (or, a mechanical key, for example, a button, a dome switch, a jog wheel, and a jog switch positioned at the front/back side or a side of the mobile terminal 60) and a touch type input means. For example, the touch type input means may include a virtual key, a soft key, or a visual key, displayed on a touch screen through software processing, or may include a touch key disposed at a portion other than the touch screen. Moreover, the virtual key or the visual key in various forms may be displayed on the touch screen and for example, may include graphic, text, icon, video or a combination thereof.

Additionally, the sensing unit 640 may sense at least one among information in a mobile terminal, information on an environment surrounding a mobile terminal, and user information and may then generate a sensing signal corresponding thereto. On the basis of such a sensing signal, the control unit 680 may control a drive or operation of the mobile terminal 60 or may perform data processing, a function or an operation relating to an application program installed at the mobile terminal 60. Representative sensors among various sensors that may be included as the sensing unit 640 will be described in more detail.

First, the proximity sensor 641 is a sensor detecting whether there is an object approaching a predetermined detection surface or whether there is an object in the vicinity without mechanical contact by using magnetic field strength or infrared. The proximity sensor 641 may be disposed in an inner area of a mobile terminal surrounded by the touch screen and or near the touch screen.

Examples of the proximity sensor 641 may include a transmission-type photoelectric sensor, a direct reflective-type photoelectric sensor, a mirror reflective-type photoelectric sensor, a high-frequency oscillation-type proximity sensor, a capacitive-type proximity sensors, a magnetic-type proximity sensor, and an infrared proximity sensor. If the touch screen is a capacitive type, the proximity sensor 641 may be configured to detect the proximity of an object by changes in an electric field according to the proximity of the object having conductivity. In this case, the touch screen (or a touch sensor) itself may be classified as a proximity sensor.

Moreover, for convenience of description, an action for recognizing the position of an object on the touch screen as the object is close to the touch screen without contacting the touch screen is called "proximity touch" and an action that the object actually contacts the touch screen is called "contact touch". A position that an object is proximity-touched on the touch screen is a position that the object vertically corresponds to the touch screen when the object is proximity-touched. The proximity sensor 641 may detect a proximity touch and a proximity touch pattern (for example, a proximity touch distance, a proximity touch direction, a proximity touch speed, a proximity touch time, a proximity touch position, and a proximity touch movement state). Moreover, the control unit 680 processes data (for information) corresponding to a proximity touch operation and a proximity touch pattern, detected through the proximity sensor 641, and furthermore, may output visual information corresponding to the processed data on the touch screen. Furthermore, according to whether a touch for the same point on the touch screen is a proximity touch or a contact touch, the control unit 680 may control the mobile terminal 60 to process different operations or data (or information).

The touch sensor detects a touch (or a touch input) applied to the touch screen (or the display unit 651) by using at least one among various touch methods, for example, a resistive film method, a capacitive method, an infrared method, an ultrasonic method, and a magnetic field method.

For example, the touch sensor may be configured to convert a pressure applied to a specific portion of the touch screen or changes in capacitance occurring at a specific portion into electrical input signals. The touch sensor may be configured to detect a position and area that a touch target applying a touch on the touch screen touches the touch sensor, a pressure when touched, and a capacitance when touched. Here, the touch target, as an object applying a touch on the touch sensor, may be a finger, a touch pen, a stylus pen, or a pointer, for example.

In such a manner, when there is a touch input on the touch sensor, signal(s) corresponding thereto are sent to a touch controller. The touch controller processes the signal(s) and then transmits corresponding data to the control unit 680.

Therefore, the control unit 680 may recognize which area of the display unit 651 is touched. Herein, the touch controller may be an additional component separated from the control unit 680 or may be the control unit 680 itself.

Moreover, the control unit 680 may perform different controls or the same control according to types of a touch target touching the touch screen (or a touch key equipped separated from the touch screen). Whether to perform different controls or the same control according to types of a touch target may be determined according to a current operation state of the mobile terminal 60 or an application program in execution.

Moreover, the above-mentioned touch sensor and proximity sensor are provided separately or combined and may thus sense various types of touches, for example, short (or tap) touch), long touch, multi touch, drag touch, flick touch, pinch-in touch, pinch-out touch, swipe touch, and hovering touch for the touch screen.

The ultrasonic sensor may recognize position information of a detection target by using ultrasonic waves. Moreover, the control unit 680 may calculate the position of a wave source through information detected by an optical sensor and a plurality of ultrasonic sensors. The position of the wave source may be calculated by using the property that light is much faster than ultrasonic wave, that is, a time that light reaches an optical signal is much shorter than a time that ultrasonic wave reaches an ultrasonic sensor. In more detail, the position of the wave source may be calculated by using a time difference with a time that ultrasonic wave reaches by using light as a reference signal.

Moreover, the camera 620 described as a configuration of the input unit 621 may include at least one among a camera sensor (for example, CCD and CMOS), a photo sensor (or an image sensor), and a laser sensor.

The camera 621 and the laser sensor may be combined to detect a touch of a detection target for a three-dimensional image. The photo sensor may be stacked on a display device and is configured to scan a movement of a detection target close to the touch screen.

In more detail, the photo sensor mounts a photo diode and a transistor (TR) in a row/column and scans content disposed on the photo sensor by using an electrical signal changing according to an amount of light applied to the photo diode. That is, the photo sensor may calculate the coordinates of a detection target according to the amount of change in light and through this, may obtain the position information of the detection target.

The display unit 651 may display (output) information processed in the mobile terminal 60. For example, the display unit 151 may display execution screen information of an application program running on the mobile terminal 60 or user interface (UI) and graphic user interface (GUI) information according to such execution screen information.

Additionally, the display unit 151 may be configured as a three-dimensional display unit displaying a three-dimensional image.

The sound output unit 652 may output audio data received from the wireless communication unit 610 or stored in the memory 170 in a call signal reception or call mode, a recording mode, a voice recognition mode, or a broadcast reception mode. The sound output unit 652 may output a sound signal relating to a function (for example, a call signal reception sound and a message reception sound) performed by the mobile terminal 60. The sound output unit 652 may include a receiver, a speaker, and a buzzer.

The haptic module 653 generates various haptic effects that a user may feel. A representative example of a haptic effect that the haptic module 653 generates is vibration. The intensity and pattern of vibration generated by the haptic module 653 may be controlled by a user's selection or a setting of a control unit. For example, the haptic module 653 may synthesize and output different vibrations or output different vibrations sequentially.

The haptic module 653 may generate various haptic effects, for example, effects by a pin arrangement moving vertical to a contact skin surface, injection power or suction power of air through an injection port or a suction port, rubbing a skin surface, electrode contact, stimulus of electrostatic force and effects by the reproduction of cold/warm sense by using a device absorbing or emitting heat.

The haptic module 653 may be implemented to deliver a haptic effect through a direct contact and also allow a user to feel a haptic effect through a muscle sense such as a finger or an arm. The haptic module 653 may be more than two according to a configuration aspect of the mobile terminal 60.

The optical output unit 654 outputs a signal for notifying event occurrence by using light of a light source of the mobile terminal 60. An example of an event occurring in the mobile terminal 60 includes message reception, call signal reception, missed calls, alarm, schedule notification, e-mail reception, and information reception through an application.

A signal outputted from the optical output unit 654 is implemented as a mobile terminal emits single color of multicolor to the front or the back. The signal output may be terminated when a mobile terminal detects user's event confirmation.

The interface unit 660 may serve as a path to all external devices connected to the mobile terminal 60. The interface unit 660 may receive data from an external device, receive power and deliver it to each component in the mobile terminal 60, or transmit data in the mobile terminal 60 to an external device. For example, the interface unit 660 may include a wired/wireless headset port, an external charger port, a wired/wireless data port, a memory card port, a port connecting a device equipped with an identification module, an audio I/O port, a video I/O port, and an earphone port.

Moreover, the identification module, as a chip storing various information for authenticating usage authority of the mobile terminal 60, may include a user identity module (UIM), a subscriber identity module (SIM), and a universal subscriber identity module (USIM). A device equipped with an identification module (hereinafter referred to as an identification device) may be manufactured in a smart card form. Accordingly, the identification device may be connected to the mobile terminal 60 through the interface unit 660.

Additionally, when the mobile terminal 60 is connected to an external cradle, the interface unit 660 may become a path through which power of the cradle is supplied to the mobile terminal 60 or a path through which various command signals inputted from the cradle are delivered to the mobile terminal 60 by a user. The various command signals or the power inputted from the cradle may operate as a signal for recognizing that the mobile terminal 60 is accurately mounted on the cradle.

The memory 670 may store a program for an operation of the control unit 680 and may temporarily store input/output data (for example, a phone book, a message, a still image, and a video). The memory 670 may store data on various patterns of vibrations and sounds outputted during a touch input on the touch screen.

The memory 670 may include at least one type of storage medium among flash memory type, hard disk type, Solid State Disk (SSD) type, Silicon Disk Drive (SDD) type, multimedia card micro type, card type memory (for example, SD or XD memory type), random access memory (RAM) type, static random access memory (SRAM) type, read-only memory (ROM) type, electrically erasable programmable read-only memory (EEPROM) type, programmable read-only memory (PROM) type, magnetic memory type, magnetic disk type, and optical disk type. The mobile terminal 60 may operate in relation to a web storage performing a storage function of the memory 670 on internet.

Moreover, as mentioned above, the control unit 680 may control operations relating to an application program and overall operations of the mobile terminal 100 in general. For example, if a state of the mobile terminal 100 satisfies set conditions, the control unit 680 may execute or release a lock state limiting an output of a control command of a user for applications.

Additionally, the control unit 680 may perform a control or processing relating to a voice call, data communication, and a video call may perform pattern recognition processing for recognizing handwriting input or drawing input on the touch screen as a text and an image, respectively. Furthermore, the control unit 680 may use at least one or a combination of the above components to perform a control in order to implement various embodiments described below on the mobile terminal 60.

The power supply unit 630 may receive external power or internal power under a control of the control unit 680 and may then supply power necessary for an operation of each component. The power supply unit 630 includes a battery. The battery is a rechargeable built-in battery and may be detachably coupled to a terminal body in order for charging.

Additionally, the power supply unit 630 may include a connection port and the connection port may be configured as one example of the interface unit 660 to which an external charger supplying power for charging of the battery is electrically connected.

As another example, the power supply unit 630 may be configured to charge a battery through a wireless method without using the connection port. In this case, the power supply unit 630 may receive power from an external wireless power transmission device through at least one among an inductive coupling method based on a magnetic induction phenomenon, and a magnetic resonance coupling method based on an electromagnetic resonance phenomenon.

Moreover, various embodiments below may be implemented in a computer or device similar thereto readable medium by using software, hardware, or a combination thereof.

The headset 10 according to embodiments of the present invention described below may have the same components as the mobile terminal 60. That is, the headset 10 may perform the same functions and operations as the mobile terminal 60.

In more detail, the headset 10 may include a wireless communication unit 110, a user input unit 120, a sensing unit 204, an output unit 140, an interface unit 160, a memory 150, a control unit 180, and a power supply unit 190.

The wireless communication unit 110 may include at least one module allowing wireless communication between the headset 10 and the mobile terminal 60.

The wireless communication unit 110 may include at least one among a radio reception module 111, a short range communication module 112, and a position information module 113. As the radio reception module 111 is mounted on the headset 10, the headset 10 itself receives radio broadcast. Although the radio reception module 111 is not directly shown in an exploded perspective view of the headset 10 according to an embodiment of the present invention, it is limited that the radio reception module 111 is mounted on the headset 10. Then, the short range communication module 112 includes a Bluetooth module 44 described below and may identically mean the short range communication module 614 in the mobile terminal 60. Then, the position information module 113 may identically mean the position information module 615 in the mobile terminal 60.

The user input unit 120 may include the above-described various buttons. That is, the user input unit 120 may include touch type buttons or keys, push keys, vibration buttons, dome switches, jog wheels, and jog switches.

The sensing unit 130 may include at least one among a proximity sensor 131, an illumination sensor 132, a touch sensor, an acceleration sensor, a magnetic sensor, a G-sensor), a gyroscope sensor, a motion sensor, an RGB sensor, an infrared (IR) sensor, a finger scan sensor, and an ultrasonic sensor. Then, the sensors may be identical to sensors equipped in the mobile terminal 60.

The output unit 140 may include at least one among a sound output unit 141, a haptic module 142, and an optical output unit 143. Then, the sound output unit 141 may include a speaker module 39 (see FIG. 6) equipped at the headset 10.

The interface unit 160 serves as a path to various kinds of external devices connected to the headset 10. The interface unit 160 may include at least one among an external charger port, a data port such as the USB port 228, a memory card port, and a portion connecting a device including an identification module such as the USIM unit 203.

Additionally, the memory 150 stores data supporting various functions of the headset10. The memory 150 may store a plurality of application programs or applications running on the headset 10, and data and commands for operations of the headset 10. At least part of such an application program may be downloaded from an external server through a wireless communication.

The control unit 180 controls overall operations of the headset 10 typically in addition to operations relating to the application program. The control unit 180 may provide or process information or functions proper for a user by processing signals, data, and information inputted/outputted through the above-mentioned components or application programs stored in the memory 150.

The power supply unit 190 may receive external power or internal power under a control of the control unit 180 and may then supply power to each component in the headset 10. The power supply unit 190 includes the battery 45 (see FIG. 6) and the battery 45 may be a built-in battery or a replaceable battery.

Moreover, the radio reception module 111 of the wireless communication unit 110 receives broadcast signals and/or broadcast related information from an external broadcast server through a broadcast channel. The broadcast channel may include a satellite channel and a terrestrial channel. At least two radio reception modules for simultaneous broadcast reception for at least two broadcast channels or broadcast channel switching may be provided to the mobile terminal 100.

The broadcast management service may mean a server generating and transmitting broadcast signals and/or broadcast related information or a server receiving pre-generated broadcast signals and/or broadcast related information and transmitting them to a terminal.

The short range communication module 112 is for short range communication and may support short range communication by using at least one among Bluetooth™, Radio Frequency Identification (RFID), infrared Data Association (IrDA), Ultra Wideband (UWB), ZigBee, Near Field Communication (NFC), Wireless-Fidelity (Wi-Fi), Wi-Fi Direct, Wireless Universal Serial Bus (Wireless USB) techniques.

The short-range communication module 112 may support wireless communication between the headset 10 and another wireless communication system and between the headset 10 and the mobile terminal 60 via wireless area networks. The wireless area networks may be wireless personal area networks.

Then, the position information module 113, as a module for obtaining the position of the headset 10, may include a module identical to the position information module 615 equipped in the mobile terminal 60.

Figure 2:
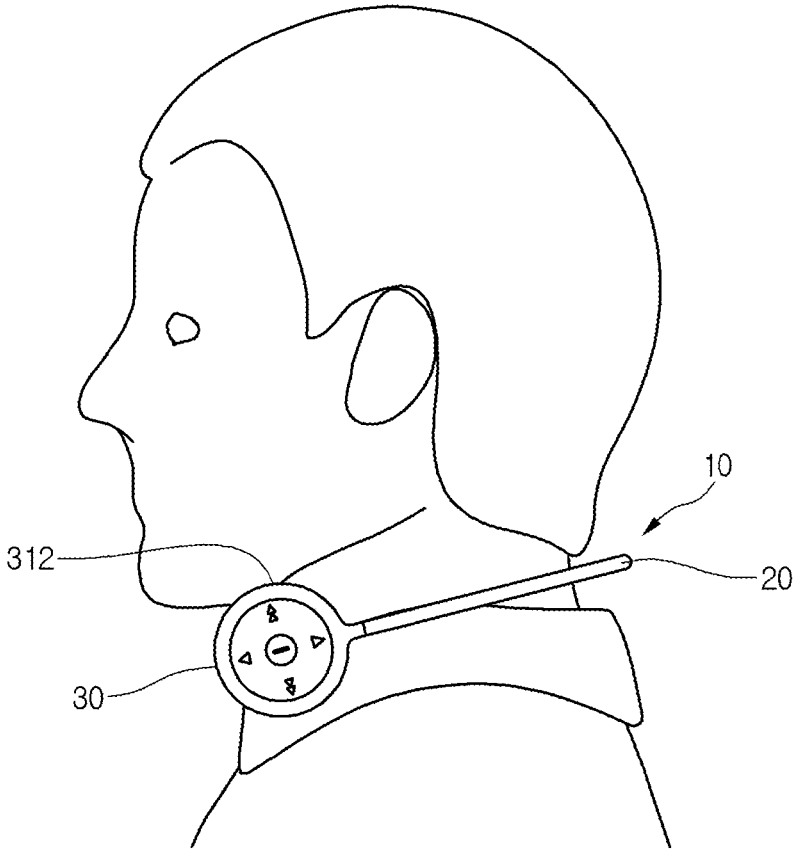
FIG. 2 is a view when a headset is worn on a neck according to an embodiment of the present invention.
Figure 3:
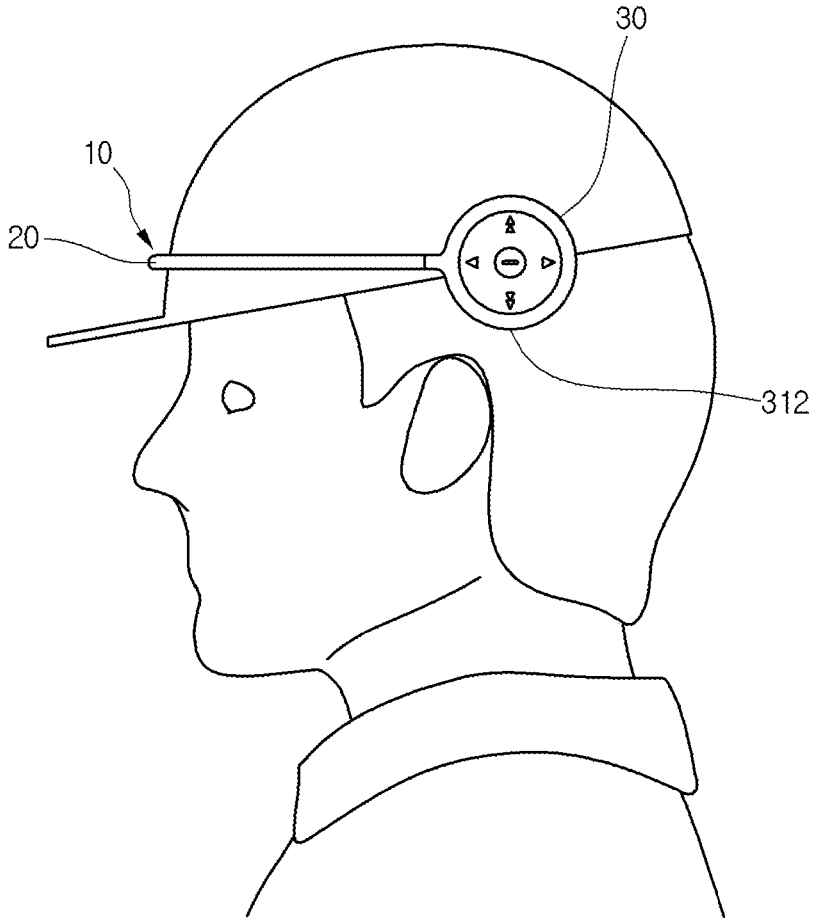
FIG. 3 is a view when a headset is worn on a cap according to an embodiment of the present invention.

FIG. 2 is a view when a user wears a headset on the neck according to an embodiment of the present invention. FIG. 3 is a view when a headset is mounted on a cap according to an embodiment of the present invention.

As shown in FIG. 2, when a user wears the headset 10 on the neck, as a sub speaker hole 312 faces the user's ear, sound directivity is obtained.

As shown in FIG. 3, when a user attaches the headset 10 to a cap, as the hook 20 surrounds the front of the cap, the sub speaker hole 312 faces down. Thus, sound directivity is obtained.

Hereinafter, a structure and functions of the headset 10 will be described in more detail with reference to the drawings.

Figure 4:
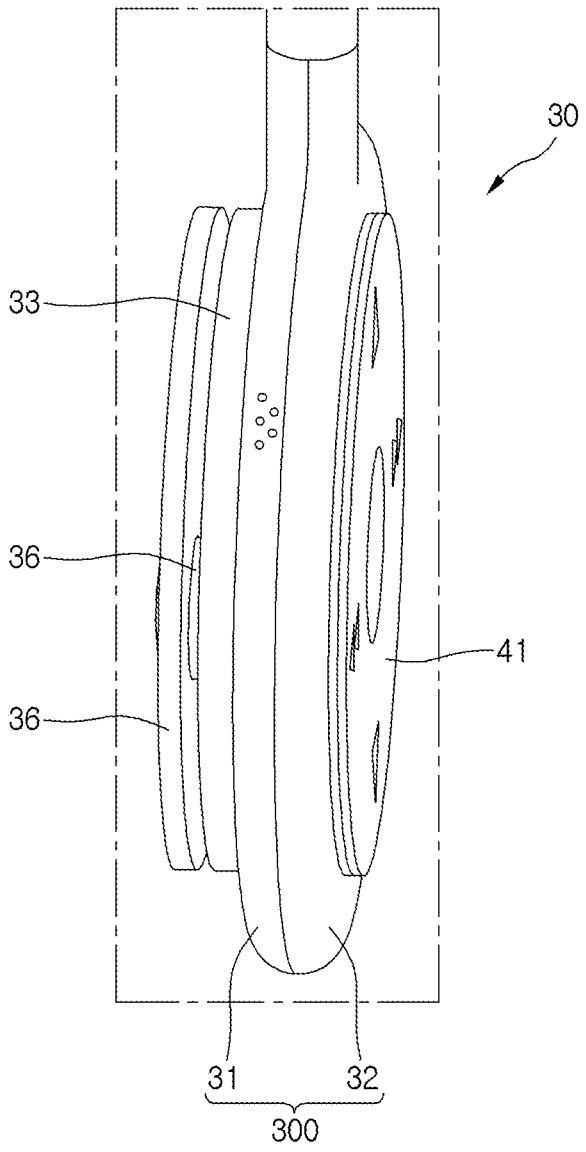
FIG. 4 is a perspective view before a sound output unit of a headset is worn on a cap according to an embodiment of the present invention.
Figure 5:
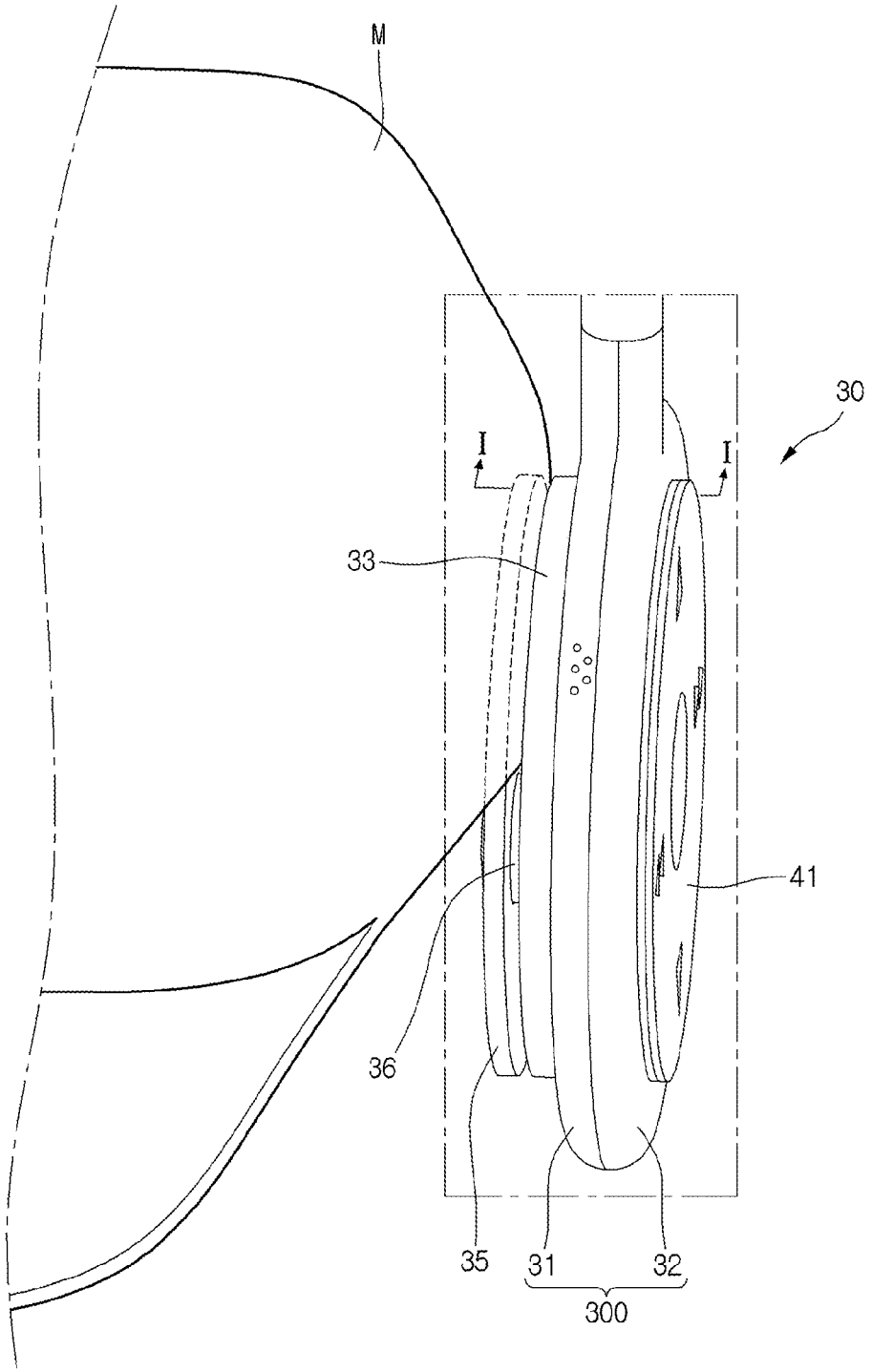
FIG. 5 is a perspective view when a sound output unit is mounted on a cap.
Figure 6:
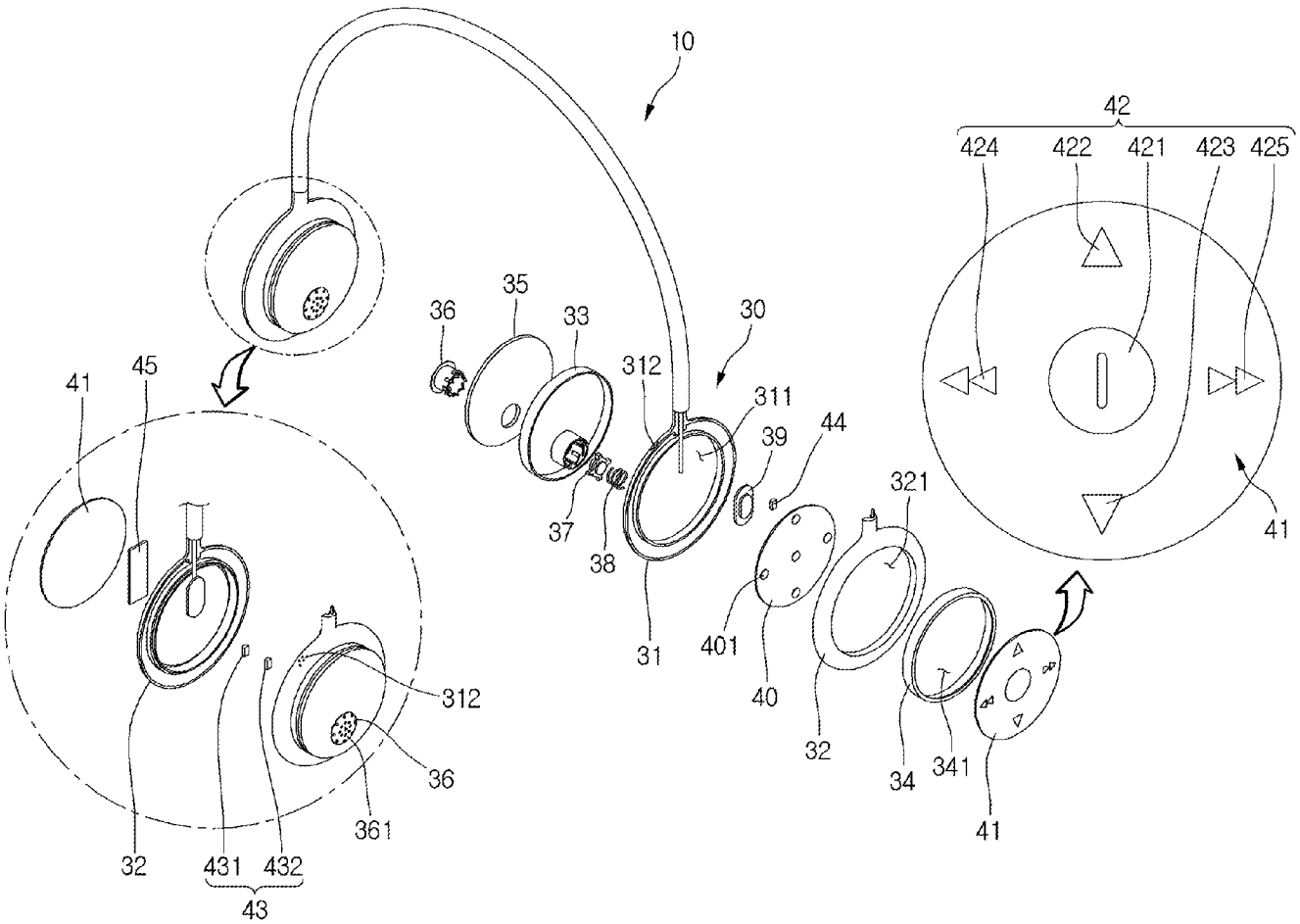
FIG. 6 is an exploded perspective view of a headset according to an embodiment of the present invention.
Figure 7:
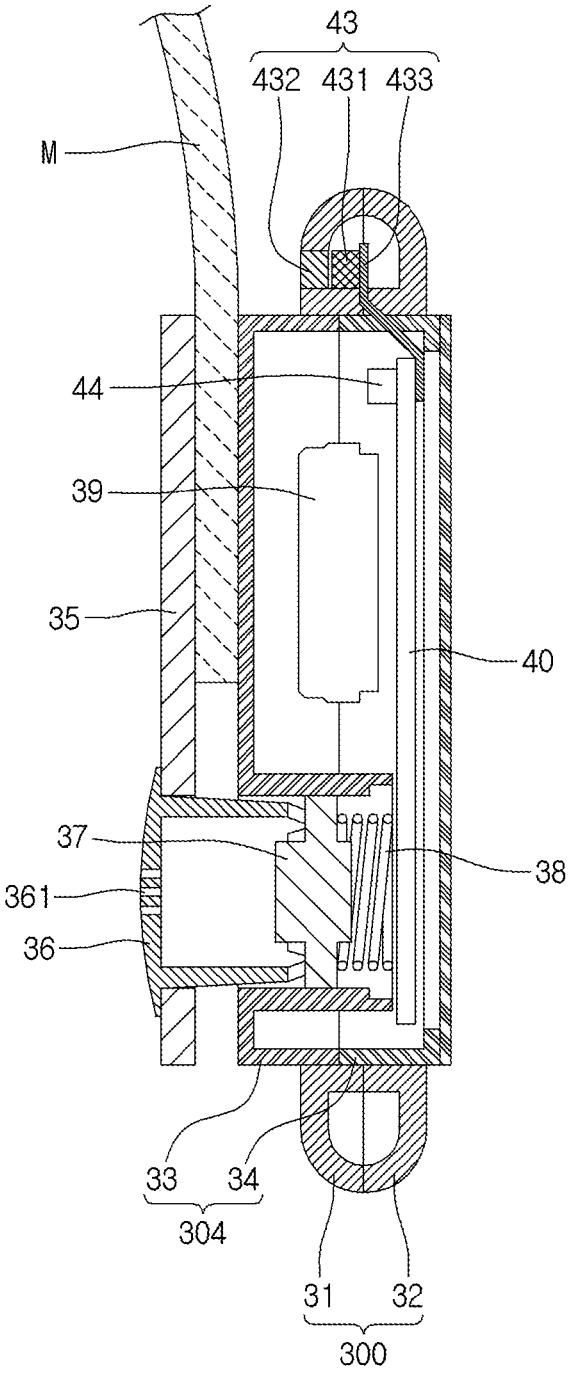
FIG. 7 is a cross-sectional view taken along a line I-I of FIG. 5.

FIG. 4 is a perspective view before a sound output unit of a headset is attached to a cap. FIG. 5 is a view when the sound output unit is attached to the cap. FIG. 6 is an exploded perspective view of a headset according to an embodiment of the present invention. FIG. 7 is a cross-sectional view taken along a line I-I of FIG. 5.

Referring to FIGS. 4 to 7, the headset 10 may be worn around the user's neck or worn by attaching to a cap M according to a user's preference. For this, a coupling structure in which the sound output unit 30 of the headset 10 is detachable from a cap is required.

According to the invention, the sound output unit 30 may be selectively coupled to the cap M by using a fixing clip 35. Then, the sound output unit 30 may be designed in a flat circular shape but is not limited thereto.

In more detail, the sound output unit 30 may include a frame 300 including an inner frame 31 and an outer frame 32, a case 304 inserted into the frame 300 and including an inner case 33 and an outer case 34, the fixing clip disposed at the outer surface of the inner case 33, a clip button 36 inserted into the inner case 33 and moving with the fixing clip 35 integrally, a stopper 37 rotating and moving by the clip button 36, a spring 38 disposed at the outer surface of the stopper 37, a main circuit board 40 seated at the outer case 34, a speaker module 39 and a Bluetooth module 44 seated at the main circuit board 40, a cover plate 41 coupled to the outer surface of the cover plate 32, a battery 45 disposed between the cover plate 41 and the main circuit board 40, and a sensor module 43 detecting the mounting position of the sound output unit 30.

As shown in FIG. 6, the sensor module 43 and the battery 45 are disposed at the left sound output unit 30 and the Bluetooth module 44 is disposed at the right sound output unit 30. However, their arrangement is not limited thereto. That is, the components may be appropriately divided and disposed at the left sound output unit 30 and the right sound output unit 30 according to a design structure of the components. According to the idea of the present invention, the components are provided to the sound output unit 30 regardless of which side of the sound output unit 30 the components are provided.

In more detail, mounting holes 311 and 321 are formed at the inner surfaces of the inner frame and the outer frame 32, respectively. Then, the case 304 is inserted into the mounting holes 311 and 321. Then, the sub speaker hole 312 may be formed at the edge portion of the inner frame 31. As shown in FIG. 2, when a user wears the headset 10 on the neck, the sub speaker hole 312 may be formed at the edge portion of the inner frame 31 to output sound toward the user's ear.

Additionally, a through hole 341 is formed at the inner surface of the outer case 34 and the main circuit board 40 is seated at the portion of the through hole 341. Then, when the cover plate 41 is coupled to the outer frame 32, the mounting hole 321 of the outer frame 32 and the through hole 341 of the outer case 34 are blocked.

A button part 42 may be formed at the outer surface of the cover plate 41 and the button part 42 may include a power button 421, a volume up button 422, a volume down button 423, a forward search button 424, and a backward search button 425. The power button 421 may be disposed at the center of the cover plate 41 and other buttons may be disposed at the edge portions of the cover plate 41. However, an arrangement structure of the buttons is not limited to a suggested embodiment and it is apparent that various forms of arrangement structures are applicable In more detail, the button part 42 does not need to have a typical button structure protruding from the outer surface of the cover plate 41. For example, the button part 42 may include figures or characters printed on the outer surface of the cover plate 41. Then, the button part 42 may be a touch button using a change in capacitance and may be a vibration detection button receiving a command by detecting a user's finger tap.

Push terminals 401 may be formed at the outer surface of the main circuit board 40. The push terminals 401 may be formed in a dome shape and may be formed at points corresponding to the positions of the buttons. Accordingly, when a user pushes the button part 42, as the push terminals 401 are pushed, a command signal that a corresponding button has may be inputted. Then, the inputted signal may be transmitted to a control unit of the mobile terminal 60 paired with the headset 10 through the Bluetooth module 44.

Additionally, the speaker module 39, the Bluetooth module 44, and the sensor module 43 may be mounted on the inner surface of the main circuit board 40. In more detail, the sensor module 43 may include an IR sensor 431 having a light transmission unit and a light reception unit and a sensor window 432 disposed at the front of the IR sensor 431.

Additionally, it is shown that the speaker module 39 is mounted on the sound output unit 30 one by one and thus sound is outputted to the main speaker hole 361 and the sub speaker hole 312. However, the present invention is not limited thereto. That is, the speaker module 39 may include a pair of speaker modules defined with a main speaker module and a sub speaker module. Then, the main speaker module may be disposed near the main speaker hole 361 and the sub speaker module may be disposed near the sub speaker hole 312. Then, according to in what form the headset 10 is worn, the main speaker module and the sub speaker module may be controlled separately.

As shown in FIG. 7, the sensor module 43 may be mounted in an inner space formed by coupling the inner frame 31 and the outer frame 32 and the sensor module 43 may be mounted on the sensor substrate 433. Then, the sensor substrate 433 may be electrically connected to the main substrate 40.

Additionally, the sensor module 43 may include a proximity sensor 131 detecting whether the sound output unit 30 is mounted on a cap, or covers a user's ear, or worn on a user's neck.

Additionally, the sensor module 43 may further include a gyro sensor (not shown) detecting a rotation state of the sound output unit 30. A function of the gyro sensor will be described in more detail with reference to the drawings.

Moreover, the clip button 36, the inner case 33, the stopper 37, and the spring 38 may be defined as a clipping module and allow the fixing clip 35 to selectively adhere to the inner case 33.

In more detail, when a lower end part of the cap M is inserted between the fixing clip 35 and the inner case 33, as the clip button 36 is pushed, the fixing clip 36 adheres to the inner case 33. Then, the fixing clip 35 and the inner case 33 adhere to the cap M, so that the sound output unit 30 is fixed at the cap M. Then, when the clip button 36 is pushed once more, the fixing clip 35 moves away from the inner case 33. Then, the sound output unit 30 is separated from the cap M.

Figure 7A:
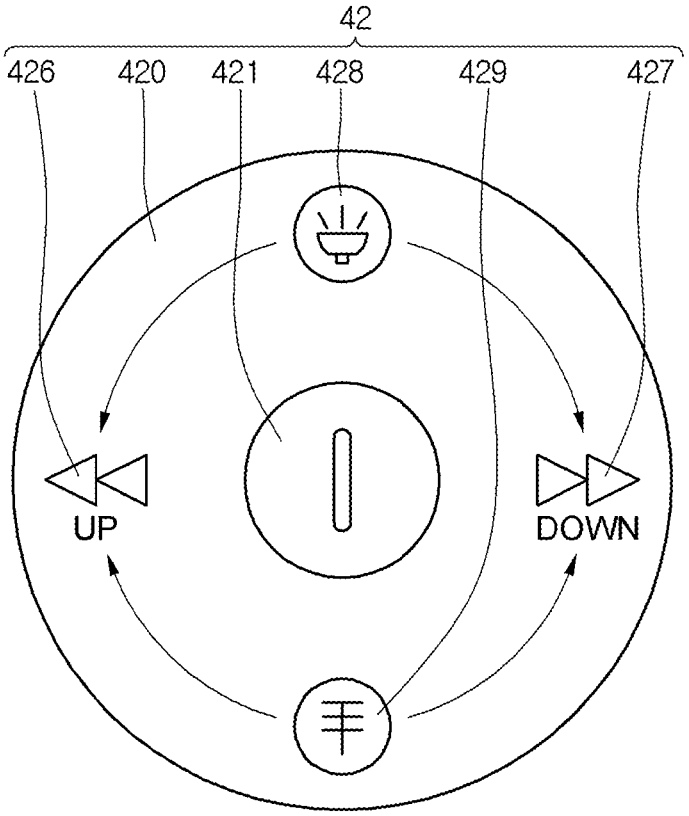
FIG. 7A is a view illustrating a configuration of a button part according to another embodiment of the inventive concept.

FIG. 7A is a view illustrating a configuration of a button part according to another embodiment of the present invention.

Referring to FIG. 7A, the button part 42 may include a wheel-key type button part having a wheel-key 420 rotatable in a clockwise or counterclockwise direction and performing volume adjustment, music search, and radio channel search through a rotation manipulation of the wheel-key 420.

In more detail, the wheel-key 420 may be rotatably mounted on the outer surface of the cover plate 41 and the cover plate 41 may perform a function of a wheel-key. Then, various adjustment buttons may be equipped at the outer surface of the wheel-key 420.

For example, the power button 421 may be equipped at the center of the wheel-key 420. The volume button 428 may be formed at the upper edge in a radial direction. The search button 429 may be formed at the lower edge in a radial direction. Then, a first display part 426 including a volume up display part and a forward search display part may be printed at the left edge of the wheel-key 420 in a radial direction. Then, a second display part 427 including a volume down display part and a backward search display part may be printed at the right edge of the wheel-key 420 in a radial direction.

Herein, the power button 421 may perform a function of a mode selection button for selecting one of a music playback mode and a radio listening mode in addition to a function for turning on/off the power of the headset 10. For example, when the power button 421 is pushed once while the power of the headset 10 is turned off, the power is on and one of the music playback mode and the radio listening mode is turned on. When the power button 421 is pushed again, the other one of the music playback mode and the radio listening mode is turned on and when a push state is maintained for a predetermined time, the power of the headset 10 is turned off.

As another method, when the power button 421 is pushed once while the power of the headset 10 is turned off, the power is on and a mode executed before the power off of the headset 10 among the music playback mode and the radio playback mode is turned on again. When the power button 421 is pushed again, mode switching is made and when a push state is maintained for a predetermined time, the power of the headset 10 is turned off. The above manipulation function of the power button 421 may be identically applied to the power button 421 shown in FIG. 6.

Additionally, when a user pushes the volume button 428 and then rotates the wheel-key 420 in a clockwise or counterclockwise direction in the music playback mode, the volume of music being played may be increased or decreased.

Then, when a user pushes the search button 429 and then rotates the wheel-key 420 in a clockwise or counterclockwise direction in the music playback mode, a song search function may be performed. That is, according to a rotation direction of the wheel-key 420, search is made to the previous song or the next song.

Moreover, while the radio listening mode is executed by a manipulation of the power button 421, when a user pushes the search button 429 and then rotates the wheel-key 420 in a clockwise or counterclockwise direction, radio channel or frequency search may be performed. Of course, when a user pushes the volume button 428 and then rotates the wheel-key 420, volume up or volume down is made like in the music playback mode.

Figure 7B:
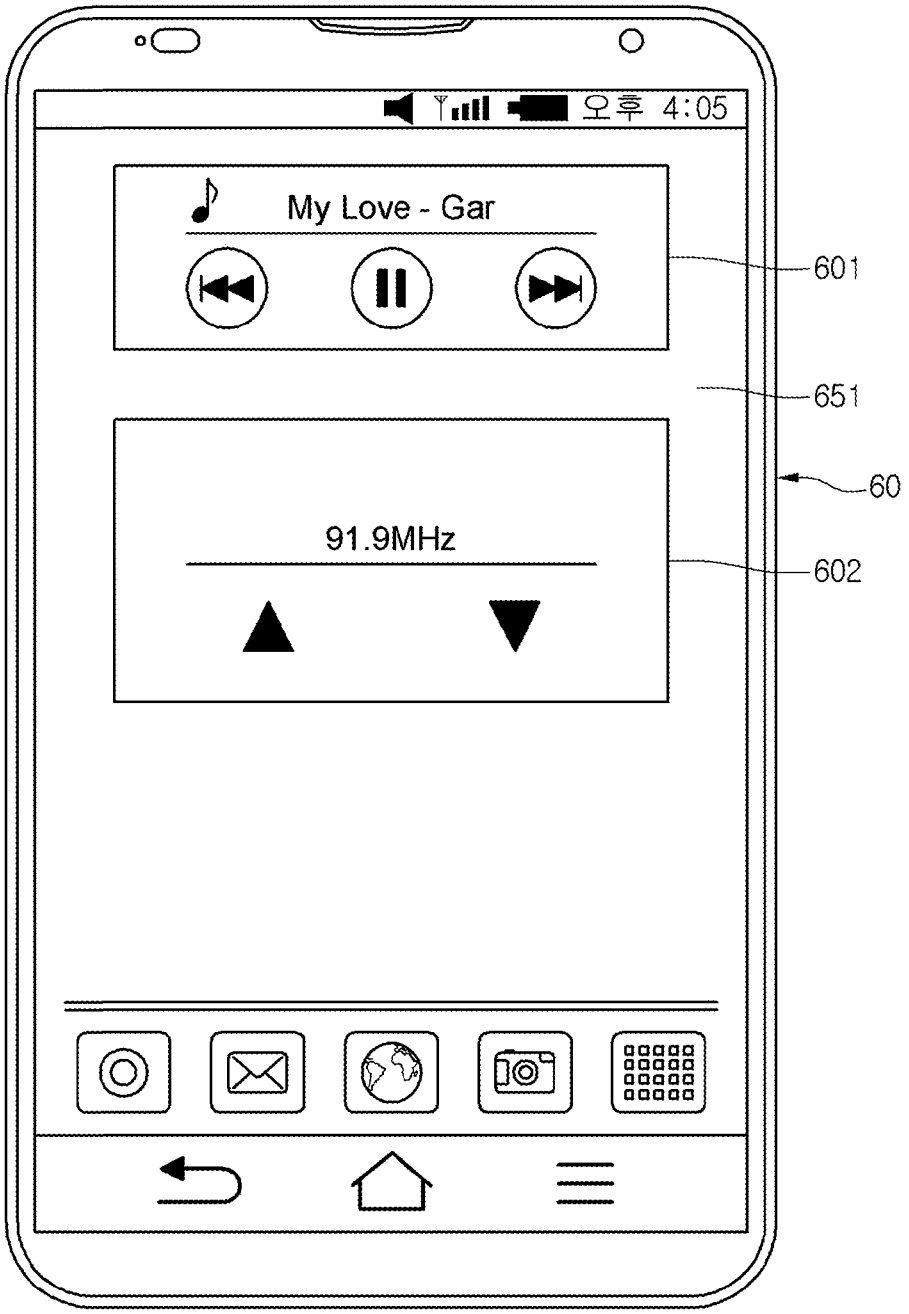
FIG. 7B is a view illustrating a display unit of a mobile terminal while a headset operates according to an embodiment of the present invention.

FIG. 7B is a view illustrating a display unit of a mobile terminal while a headset operates according to an embodiment of the present invention.

Referring to FIG. 7B, while the headset 10 is turned on and music is played or a radio broadcast is received, an operating state of the headset 10 is displayed on the display unit 651 of the mobile terminal 60.

In more detail, the display unit 651 of the mobile terminal 60 may be divided into a music playback display area 601 and a radio broadcast display area 602. Herein, the music playback display area 601 and the radio broadcast display area 602 may be displayed while the display unit 651 is in a lock state. Then, when the lock state of the display unit 651 is released, a currently operating display area may be displayed on the entire screen of the display unit 651. For example, when a user currently listens to music stored in the mobile terminal 60 or provided from a music providing site in connection to internet through the headset 10, if the user releases the lock state of the display unit 651, the music playback display area 601 may extend to be displayed on the entire display unit 651.

Then, when the headset 10 is turned on and operates or is turned off and does not operate, the music playback display area 601 and the radio broadcast display area 602 are separately displayed on the display unit 651. When the headset 10 is turned off, information on a playback state or a broadcast reception state just before operation stop may be separately displayed on the display areas 601 and 602. In this state, when a user touches one of the areas 601 and 602, a mode corresponding to the touch area may be performed. For example, when a user touches the music playback display area 601, the music stopped after played may be played continuously. Or, when a user touches the radio broadcast display area 602, a radio channel that the user listens to before stopping is turned on and thus it is possible to listen to the radio channel.

Figure 8:
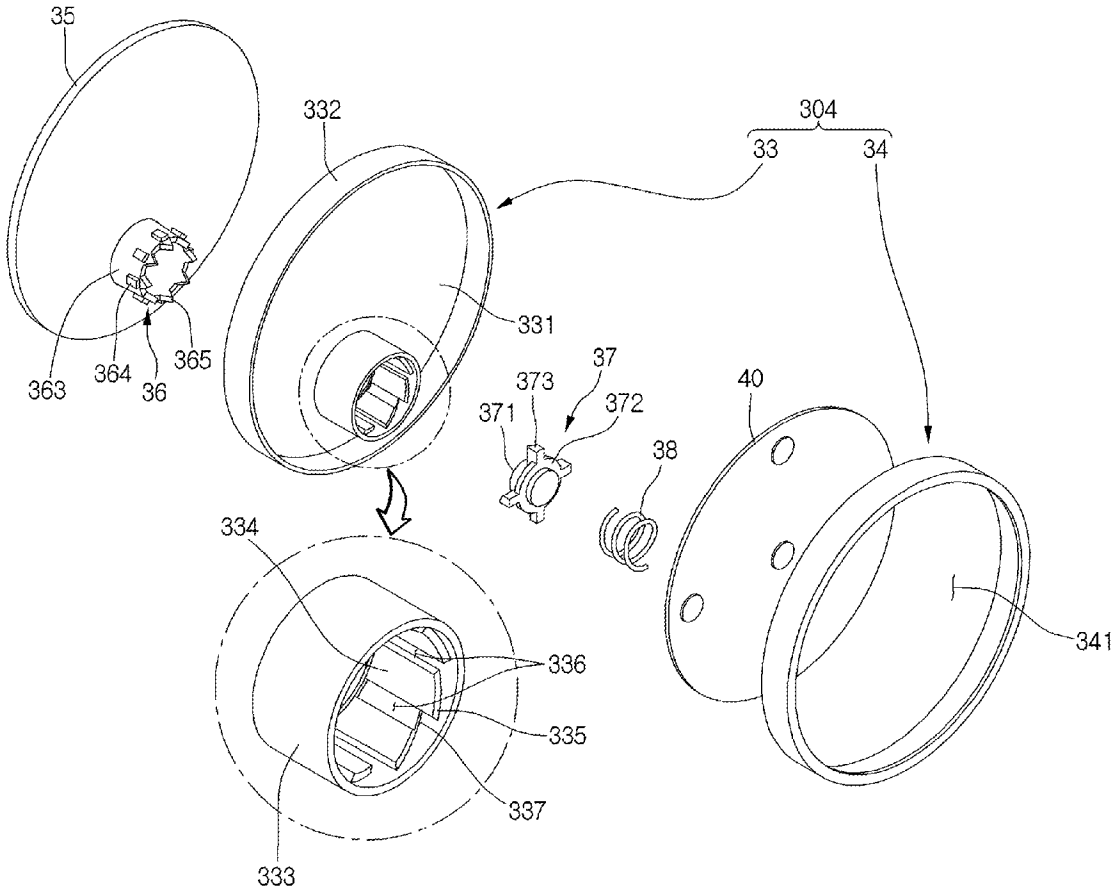
FIG. 8 is an exploded perspective view illustrating a clipping module according to an embodiment of the present invention.

FIG. 8 is an exploded perspective view illustrating a clipping module according to an embodiment of the present invention.

Referring to FIG. 8, the clipping module may include a fixing clip 35, a clip button 36, an inner case 33, a stopper 37, and a spring 38. Then, the clipping module may be received in a space formed by coupling the inner case 33 and the outer case 34 and the spring 38 may be seated on the inner surface of the main surface 40. As another method, a support plate having a predetermined width and length in the center direction of the case 304 extends in the inner peripheral surface of the case 304. It is possible to have a structure in which the spring 38 is seated at the support plate. Then, the damage of the main circuit board 50 due to the force applied to the clip button 36 may be prevented.

In more detail, the fixing clip 35 moves integrally with the clip button 36. Then, the clip button 36 includes a head part 362 where the main speaker hole 361 is formed and a cylindrical button body 363 extending from the head part 362. A plurality of push protrusions 365 protrude in a wedge shape at the end part of the button body 363 and are arranged along the cylindrical surface of the button body 363 at regular intervals. Then, a plurality of guide protrusions 364 protrude at the outer peripheral surface of the button body 363 and one guide protrusion 364 is formed at each region where the push protrusion 365 is formed. In more detail, the center of the guide protrusion 364 and the tip part of the push protrusion 365 are disposed on the same line. Then, the button body 363 extends in a hollow cylindrical shape and has a smaller diameter as it approaches the end part. That is, the button body 363 is formed to be inclined.

The inner case 33 includes a bottom part 331 where the fixing clip 36 adheres, a sidewall part 332 extending at the edge of the bottom part 331, and a guide sleeve 333 extending in a cylindrical shape at the bottom part 331. The sidewall part 332 extends in a direction perpendicular to the bottom part 331 and the button body 363 of the clip button 36 is inserted into the guide sleeve 333.

Additionally, a plurality of guide ribs 334 protrude at the inner peripheral surface of the guide sleeve 333 and extend in the length direction of the guide sleeve 333. Then, a guide groove 336 is formed between adjacent guide ribs 334 and the guide protrusion 364 of the clip button 36 is inserted into the guide groove 336. Accordingly, when the clip button 36 is pushed, the guide protrusion 364 slides along the guide groove 336. Then, the end part of the guide rib 334 is formed to be inclined at a predetermined angle. Then, a hook shoulder 337 protruding at a thickness thinner than the protrusion thickness of the guide rib 334 is formed at some of the guide grooves 336 and the hook shoulder 337 and the guide groove 336 are formed alternately. Then, the end part of the hook shoulder 337 is formed to be inclined at the same angle as the inclined surface 335 of the guide rib 334. That is, the end part of the guide rib 334 and the end part of the hook shoulder 337 are disposed on the same line.

Moreover, the stopper 37 includes a base 372, a stopper body extending at one side of the base 372, and a stopping protrusion 373 extending a predetermined length in a radial direction at the outer peripheral surface of the stopper body 371. The stopper body 371 may be formed in a cylindrical shape but is not limited thereto. Moreover, the stopping protrusion 373 has a predetermined width in the length direction of the stopper body 371. Additionally, the end part of the stopping protrusion 373, in more detail, the end part in the length direction of the stopper body 371 is formed to be inclined thereby forming a push surface 374. A push protrusion 365 of the clip button 36 selectively adheres to the push surface 374. Then, one end of the spring 38 adheres to the other side of the base 372 and extends or contracts according to the movement of the stopper 37.

Hereinafter, an operation of the clipping module will be described in more detail with reference to the drawings.

Figure 9:
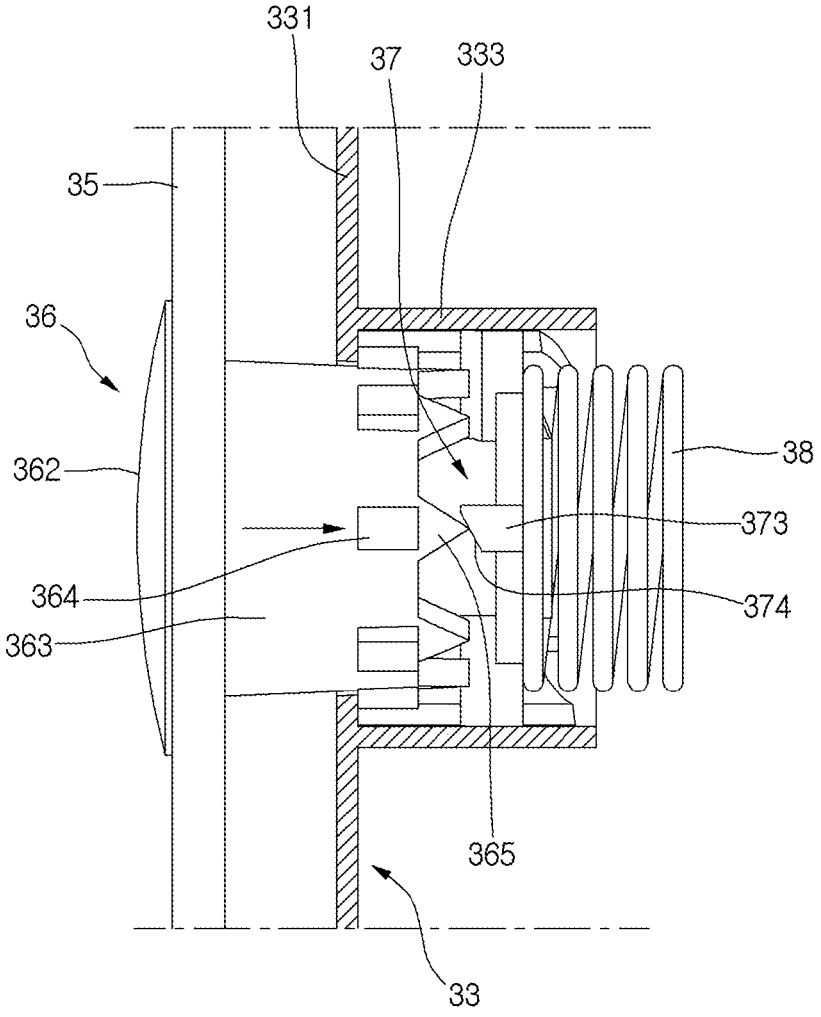
FIG. 9 is a cross-sectional view when a clipping module operates according to an embodiment of the present invention.
Figure 10:
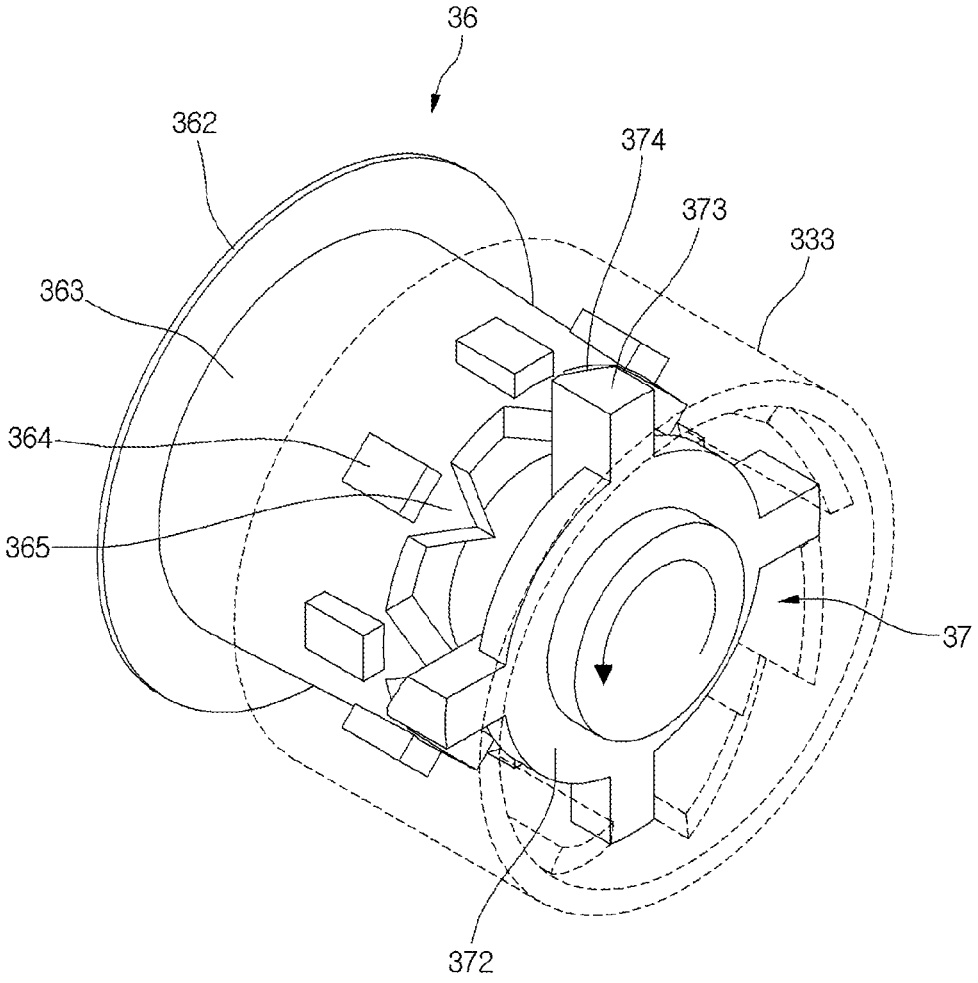
FIG. 10 is a rear perspective view when the clipping module operates.

FIG. 9 is a cross-sectional view illustrating an operation of a clipping module according to an embodiment of the present invention. FIG. 10 is a rear perspective view illustrating an operation of the clipping module.

Referring to FIGS. 9 and 10, when a head part 362 of the clip button 36 is pushed, the guide protrusion 364 pushes the stopper 37 and moves along the guide groove 336. Herein, the stopping protrusion 373 of the stopper 37 is inserted into the guide groove 336 and the stopping protrusion 373 contacts the push protrusion 365. Accordingly, while the push protrusion 365 contacts the push surface 374 of the stopping protrusion 373, it pushes the stopper 37 and accordingly, the spring 38 is compressed.

Additionally, as soon as the stopping protrusion 373 is separated from the guide groove 336, it rotates. In more detail, since the push surface 374 is formed to be inclined at a predetermined angle, when the stopping protrusion 373 is separated from the guide groove 336, the push surface 364 rotates in contact with the push protrusion 365 due to the restoring force of the spring 38.

Then, the stopping protrusion 373 rotates along the inclined surface 335 of the guide rib 334 and is fixed as hooked to the end part of the hook shoulder 337. Then, the clip button 36 is fixed together.

In this state, when the clip button 36 is pushed and released, the stopping protrusion 373 of the stopper 37 moves in a direction of compressing the spring 38 and rotates as soon as it is separated from the end part of the guide rib 334. Then, as the stopping protrusion 373 rotates along the inclined surface of the guide rib 334 and then is positioned at the end part of the guide groove 336. In this state, when the force of pushing the clip button 36 is removed, the stopper 37 moves along the guide groove 336 and then, pushes the clip button 36 due to the restoring force of the spring 38. Then, the fixing clip 35 moves away from the bottom part 331 of the inner case 33 and thus, the sound output unit 30 is separated from the cap M.

Hereinafter, an operation of the clipping module will be described for each step in more detail with reference to the drawings.

Figure 11:
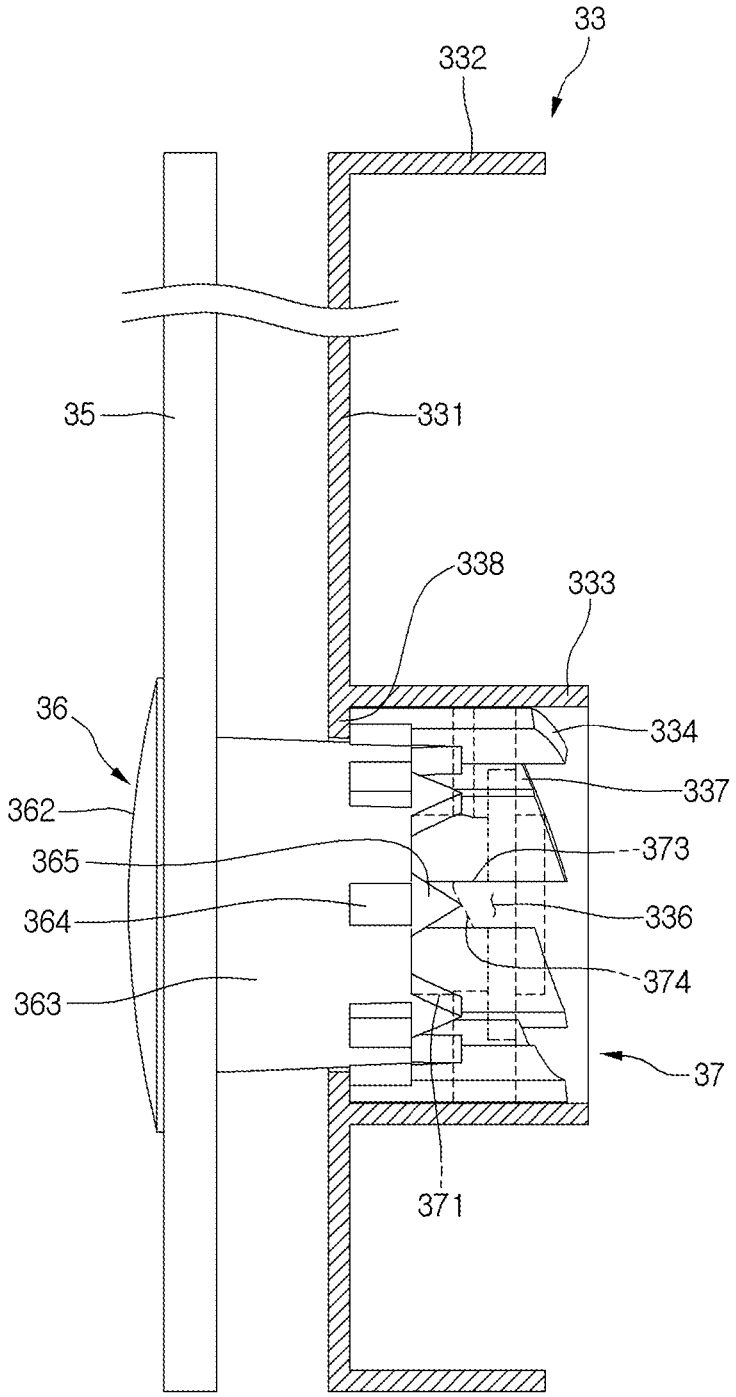
FIG. 11 is a cross-sectional view of a clipping module when a sound output unit is not mounted on a cap.

FIG. 11 is a cross-sectional view of a clipping module when a sound output unit is not mounted on a cap.

Referring to FIG. 11, when the sound output unit 30 is not coupled to the side of the cap M, the head part 362 of the clip button 36 is spaced apart from the bottom part 331 of the inner case 33. Then, the fixing clip 35 moving integrally with the clip button 36 is spaced apart from the bottom part 331 of the fixing clip 35.

In more detail, a seating projection 338 protrudes at the inner peripheral surface of the bottom part of the guide sleeve 333 extending from the bottom part 331 of the inner case 33. Then, a button hole 339 (see FIG. 13) where the body part 363 of the clip button 36 is inserted is formed at the inner side of the seating projection 338. The diameter of the button hole 339 is formed to be smaller than the inner diameter of the guide sleeve 333. Accordingly, the body part 363 of the clip button 36 is separated from the button hole 339 but the guide protrusion 364 is hooked by the seating projection 338 and thus the body part 363 is not completely separated from the button hole 339.

In such a way, in a default state in which the sound output unit 30 is not coupled to the cap M, a state in which the guide protrusion 364 of the clip button 36 is hooked by the seating projection 338 is maintained. Then, the stopper 37 is received inside the body part 363 as the spring 38 is pushed by the elastic force.

In more detail, in the default state, a state in which the stopping protrusion 373 of the stopper 37 adheres to the push protrusion 365 is maintained. To be more specific, a state in which the push protrusion 365 of the clip button 36 contacts the push surface 374 of the stopping protrusion 373 is maintained.

Figure 12:
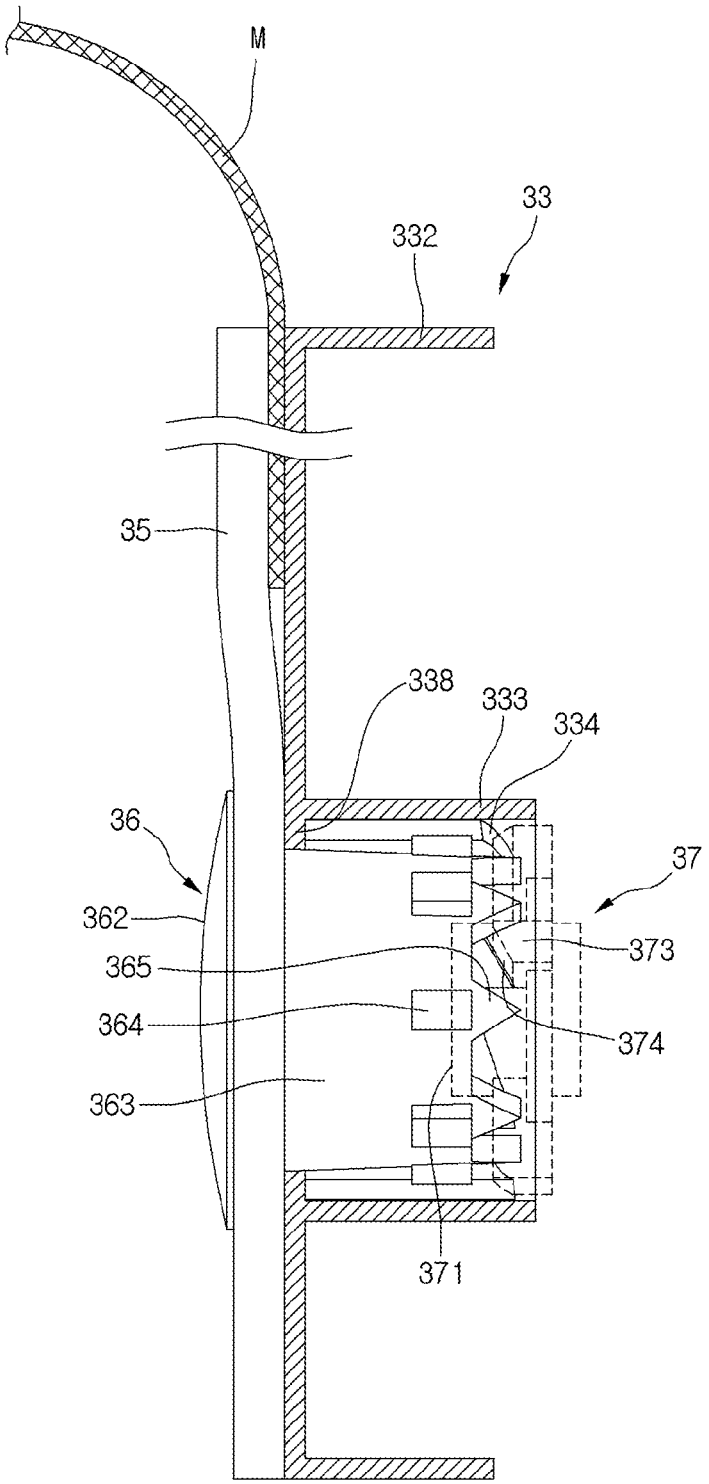
FIG. 12 is a sectional view when a sound output unit is mounted on a cap.

FIG. 12 is a sectional view when a sound output unit is mounted on a cap.

Referring to FIG. 12, in order to mount the sound output unit 30 on the cap M, the side part of the cap M is inserted between the fixing clip 35 and the bottom part of the inner case 33. Then, the fixing clip 35 applies a pressure to the side part of the cap M by pushing the clip button 36.

In this state, the stopping protrusion 373 of the stopper 37 is hooked by the hook shoulder 337 and fixed and the push protrusion 365 of the clip button 36 is fixed in contact with the stopping protrusion 373. In this state, as frictional force between the outer peripheral surface of the body part 363 of the clip button 36 and the inner peripheral surface of the seating projection 338 is applied, the clip button 36 is not separated. The clip button 36 is designed to allow such a frictional force to have a greater value than a reaction occurring when the fixing clip 35 pushes the side part of the cap M.

Herein, the body part 363 is formed to be inclined in a form in which the diameter becomes smaller as it approaches the end part. The seating projection 338 is formed to be inclined at the same angle as the body part 363 and has a structure in which their surfaces contact each other.

FIGS. 13 to 17 are views sequentially illustrating a process for mounting a sound output unit on a cap by using a clip button and a process of separating the sound output unit mounted on the cap.

Figure 13:
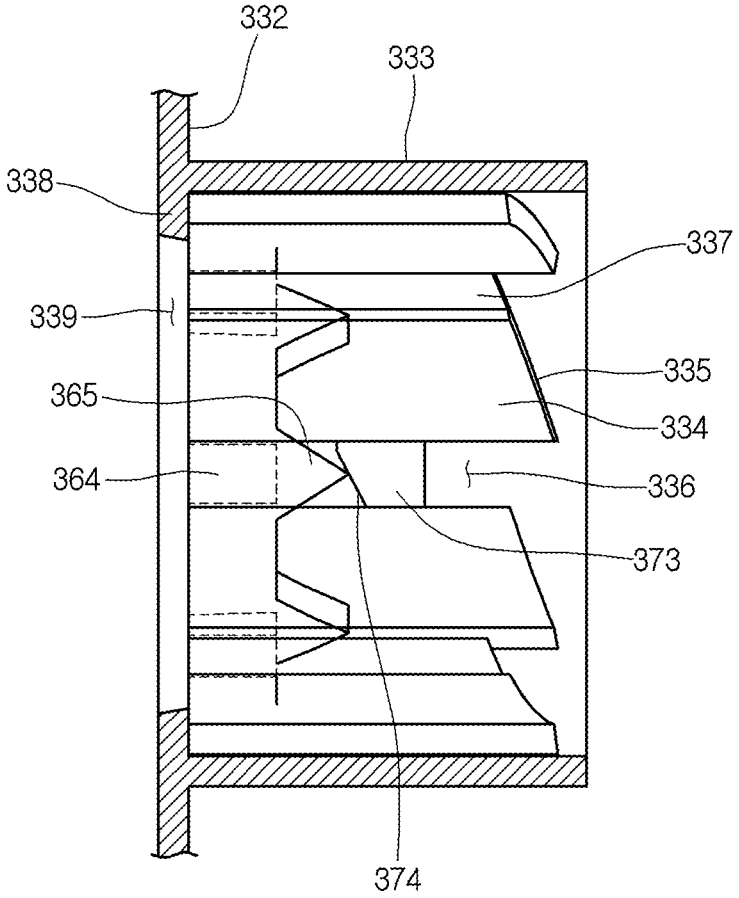
FIGS. 13 to 17 are views sequentially illustrating a process for mounting a sound output unit on a cap by using a clip button and a process of separating the sound output unit mounted on the cap.

Referring to FIG. 13, when the sound output unit 30 is not mounted on a cap, that is, as shown in FIG. 11, the guide protrusion 364 of the clip button 36 is hooked by the seating projection 338 of the guide sleeve 333 and the hook protrusion 373 of the stopper 37 is in contact with the push protrusion 365.

Figure 14:
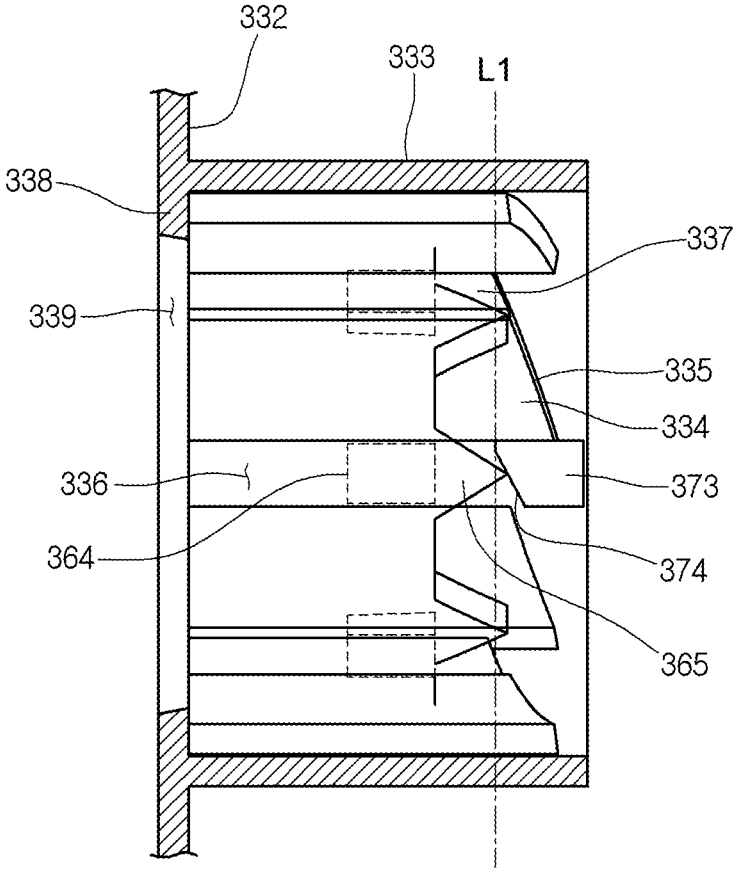

Referring to FIG. 14, the side part of the cap M shown in FIG. 13 is inserted between the fixing clip 35 and the bottom part 331 of the inner case 33 and the clip button 36 is pushed. Then, the fixing clip 35 moves together with the clip button 36 and becomes close to the inner side of the cap M.

In more detail, when the clip button 36 is pushed, the guide protrusion 364 moves along the guide groove 336 and the push protrusion 364 pushes the hook protrusion 373 of the stopper 37.

Then, until the sharp end part of the hook protrusion 373 and the lower end part of the hook shoulder 337 are positioned on the same line L1, the outer peripheral surface of the clip button 36 does not contact the end part of the seating projection 338. Then, when the sharp end part of the hook protrusion 373 and the lower end part of the hook shoulder 337 are positioned on the same line L1, the outer peripheral surface of the clip button 36 surface-contacts the end part of the seating projection 338, thereby generating a predetermined magnitude of frictional force.

Also, in this state, the fixing clip 35 pushes the cap M and the magnitude of frictional force occurring at this point is greater than the repulsive force acting toward the fixing clip 35. Accordingly, since the fixing clip 35 and the bottom part 331 of the inner case 33 hold the cap M by the frictional force, the sound output unit 30 is not separated from the cap M.

Figure 15:
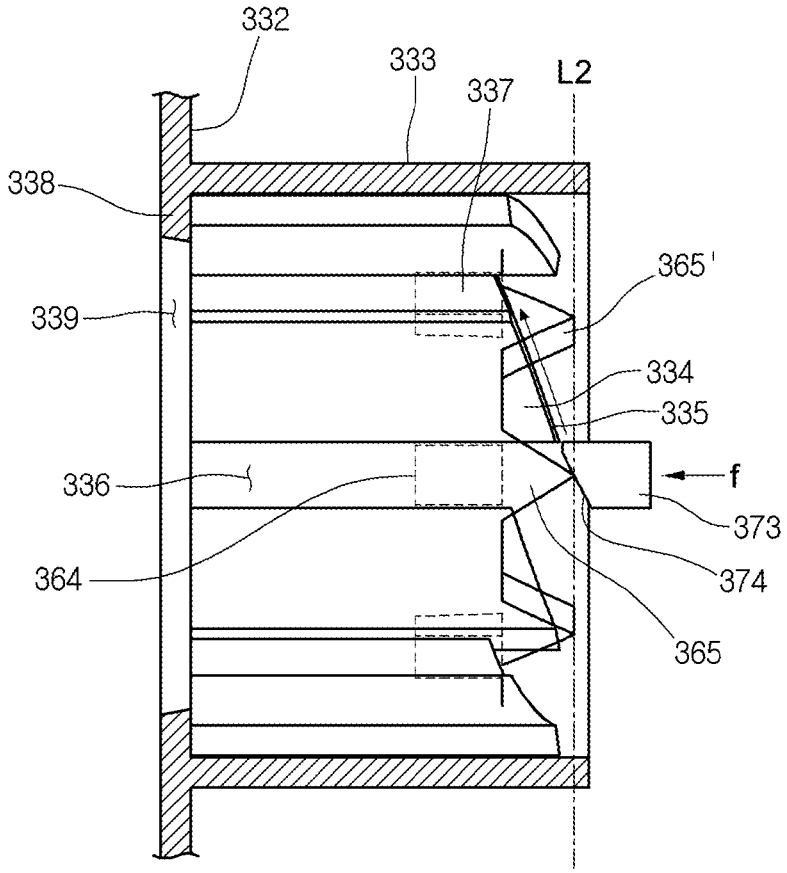

Referring to FIG. 15, as the force that pushes the clip button 36 shown in FIG. 14 is removed, the clip button 36 is pushed in the opposite direction by the restoring force of the spring 38. Thus, the sound output unit 30 is separated from the cap M.

Accordingly, the clip button 36 is pushed to move to a point where the sharp end part of the hook protrusion 373 is out of the upper section of the guide rib 334. That is, the end part of the push protrusion 365 moves to the line L2 shown in the drawing. During this process, the magnitude of a frictional force occurring between the outer peripheral surface of the body part 363 of the clip button 36 and the end part of the seating projection 338 may be further increased. However, such an increased frictional force is much smaller than the magnitude that a user cannot push the clip button 36 by a finger.

That is, the end part of the push protrusion 365 further moves a distance D from L1 to L2 and the distance D is a relatively short distance compared to the length of the guide sleeve 33.

Then, since the hook protrusion 373 is out of the guide groove 336, it rotates by the restoring force f of the spring 38. That is, when the restoring force f of the spring 38 is applied on the hook protrusion 373, the push protrusion 365 slides the push surface 374 of the hook protrusion 373 and tries to rotate in one direction (toward the bottom). However, since the clip button 36 is fixed by a user, the hook protrusion 373 rotates in the other direction (toward the top). Then, the push surface 374 of the hook protrusion 373 is seated at the inclined surface 335 of the guide rib 334 and rotates along the inclined surface 335 in the arrow direction. At this point, a user removes the force of pushing the clip button 36. An operation that a user removes the force that pushes the clip button 36 and an operation that the hook protrusion 373 rotates along the inclined surface 335 occur almost simultaneously.

Moreover, while the hook protrusion 373 rotates, the hook protrusion 373 is hooked by the inclined side of the push protrusion 365' adjacent to the push protrusion 365 that pushes the hook protrusion 373. In this state, the user's force pushing the clip button 36 is removed and only the frictional force between the body part 363 of the clip button 36 and the seating projection 338 acts on the clip button 36. Then, the restoring force of the spring 38 is large enough and thus is greater than the frictional force acting on the body part of the clip button 36. Accordingly, when the hook protrusion 373 applies a pressure to the side part of the adjacent another push protrusion 365', the clip button 36 moves in a direction (left on the drawing) in which the clip button 36 is separated from the guide sleeve 333.

In more detail, since the guide protrusion 364 of the clip button 36 is received at the guide groove 336, only the linear movement of the clip button 36 is possible. Accordingly, as the hook protrusion 373 pushes the inclined side part of the adjacent push protrusion 365', the clip button 36 moves to the left on the drawing.

Figure 16:
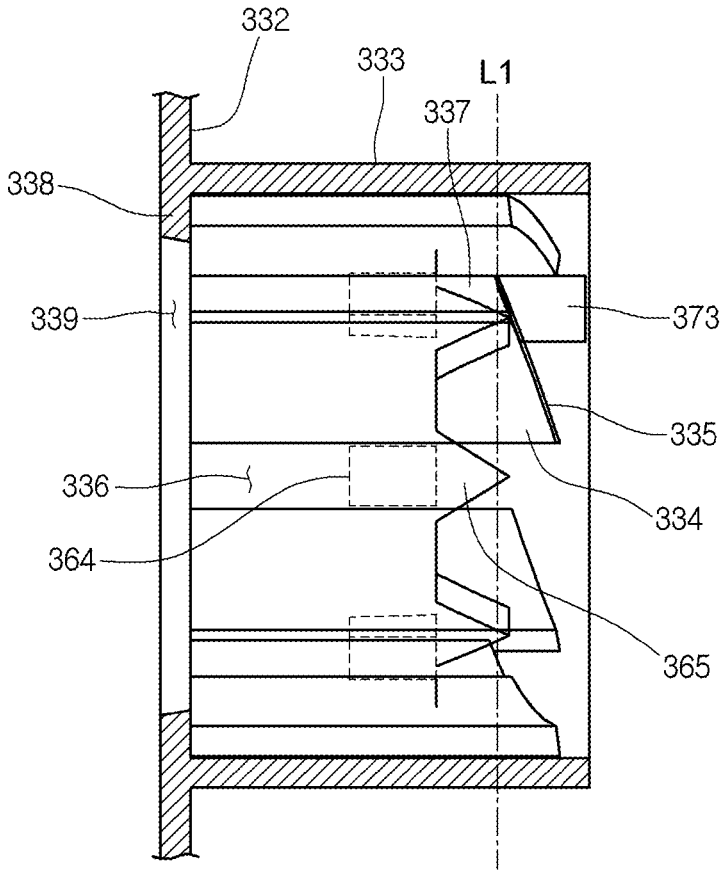

Referring to FIG. 16, as described with reference to FIG. 15, the clip button 36 moves in a direction that it is separated from the guide sleeve 333 and the hook protrusion 373 is completely seated on the hook shoulder 337. That is, as shown in FIG. 16, the sharp end part of the hook protrusion 373 is positioned at the line L1 and is seated on the hook shoulder 337.

Then, when the hook protrusion 373 is seated on the hook shoulder 337, since the hook protrusion 373 does not push the push protrusion 365' any more, the clip button 36 stops by the frictional force occurring between the body part 363 and the seating projection 338. In this state, the frictional force refers to a frictional force having the same magnitude as the friction force of FIG. 14.

Figure 17:
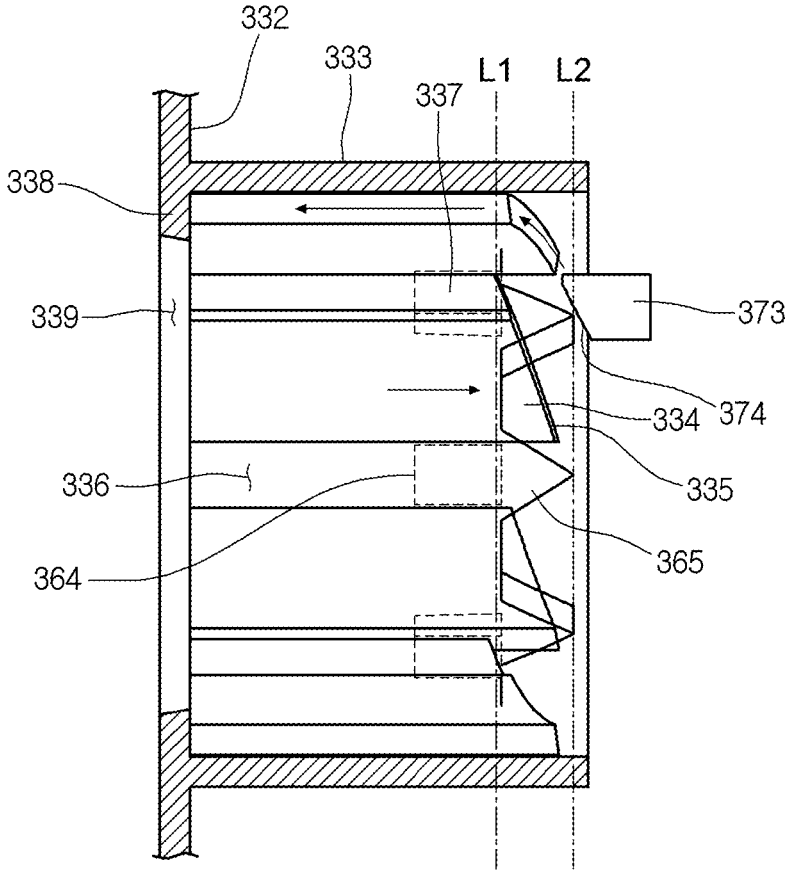

Referring to FIG. 17, in order to separate the sound output unit 30 from the cap, the clip button 36 is pushed again. Then, the push protrusion 365 pushes the hook protrusion 373 and the sharp end part of the hook protrusion 373 moves to the inclined surface 335 of the guide rib 334. In this state, the end part of the push protrusion 365 is positioned at the line L2. Then, the hook protrusion 373 is out of the guide groove 336 and the restoring force of the spring 38 acts on the base 372 of the stopper 37.

In more detail, since the push surface 374 of the hook protrusion 373 is inclined, as mentioned above, the hook protrusion 373 rotates, and also slides along the inclined surface 336 of the guide rib 334 adjacent to the hook shoulder 337. Then, the hook protrusion 373 moves in the arrow direction along the guide groove 336 formed at the side of the guide rib 334 and also pushes the guide protrusion 364 received at the guide groove 336. Then, the stopper 37 and the clip button move integrally and the clip button 36 moves in a direction that it is separated from the guide sleeve 333. At this point, the restoring force of the spring 38 that pushes the stopper 37 is greater than the frictional force between the body part 363 of the clip button 36 and the seating projection 338. Accordingly, the clip button 36 is separated from the guide sleeve 333 and the fixing clip 35 is separated from the bottom part 331 of the inner case 33. Then, the sound output unit 30 is separable from the cap M.

Figure 18:
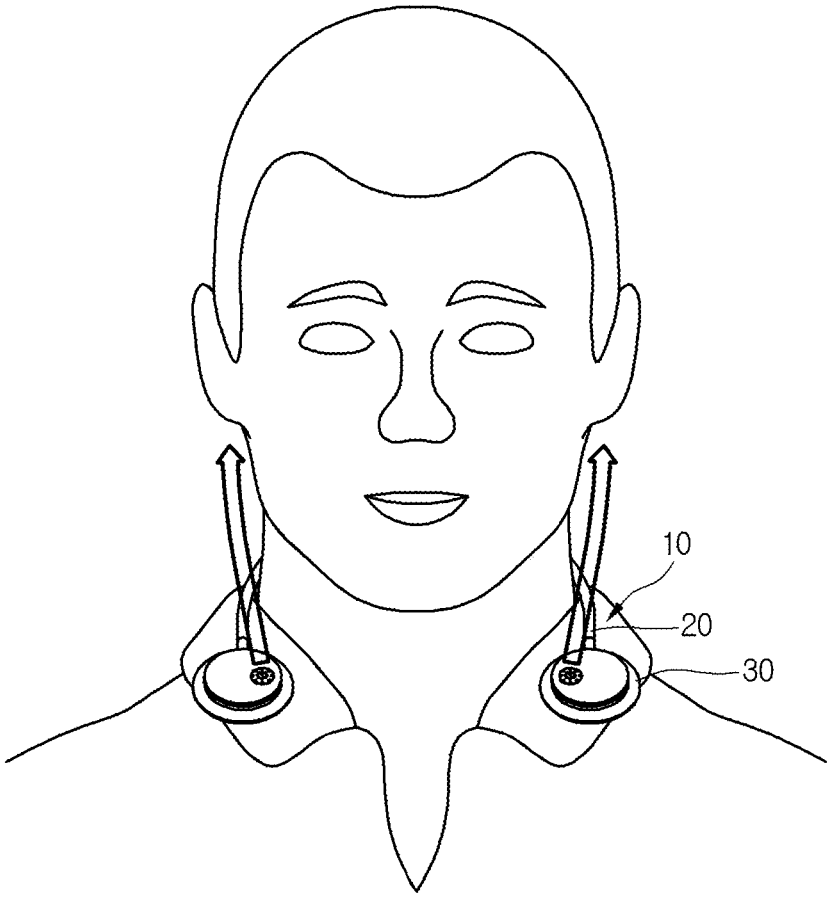
FIG. 18 is view when a headset is worn on a user's neck according to an embodiment of the present invention.
Figure 19:
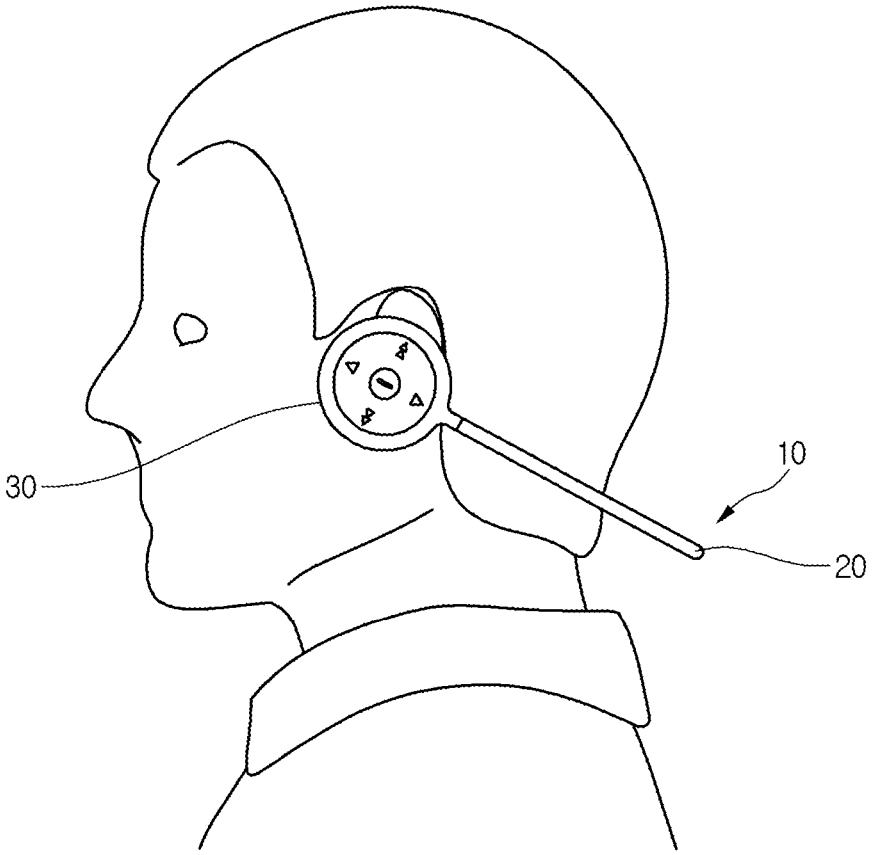
FIG. 19 is a view when the headset is worn on a user's ear.

FIG. 18 is a view when a user wears a headset on the neck according to an embodiment of the present invention. FIG. 19 is a view when a user wears the headset on the ear according to an embodiment of the present invention.

Referring to FIG. 18, while wearing the headset 10 on the neck, a user rotates the sound output unit 30 and thus, the main speaker hole 361 faces the user's ear. Therefore, sound directivity may be obtained. That is, even when the sound output unit 30 does not contact the ear, a user may hear sound effectively.

Additionally, as shown in FIG. 19, a user may wear the headset 10 according to a typical method of wearing a headset. That is, the hook 20 goes to the back of the head and the sound output unit 30 contacts the user's ear. Therefore, it is possible to listen to the sound from the main speaker hole 361. At this point, the IR sensor 431 may be programmed to detect this and lower the volume of sound automatically. For this, the sound output unit 30 may need to be rotatably connected to the hook 20. This structure will be described in more detail below with reference to the drawing.

Moreover, as shown in FIGS. 2 and 18, the sound directivities of the main speaker hole 361 and the sub speaker hole 312 may be formed to intersect each other. For example, the sound directivities of the speaker holes 361 and 312 may be designed to intersect each other.

Figure 20:
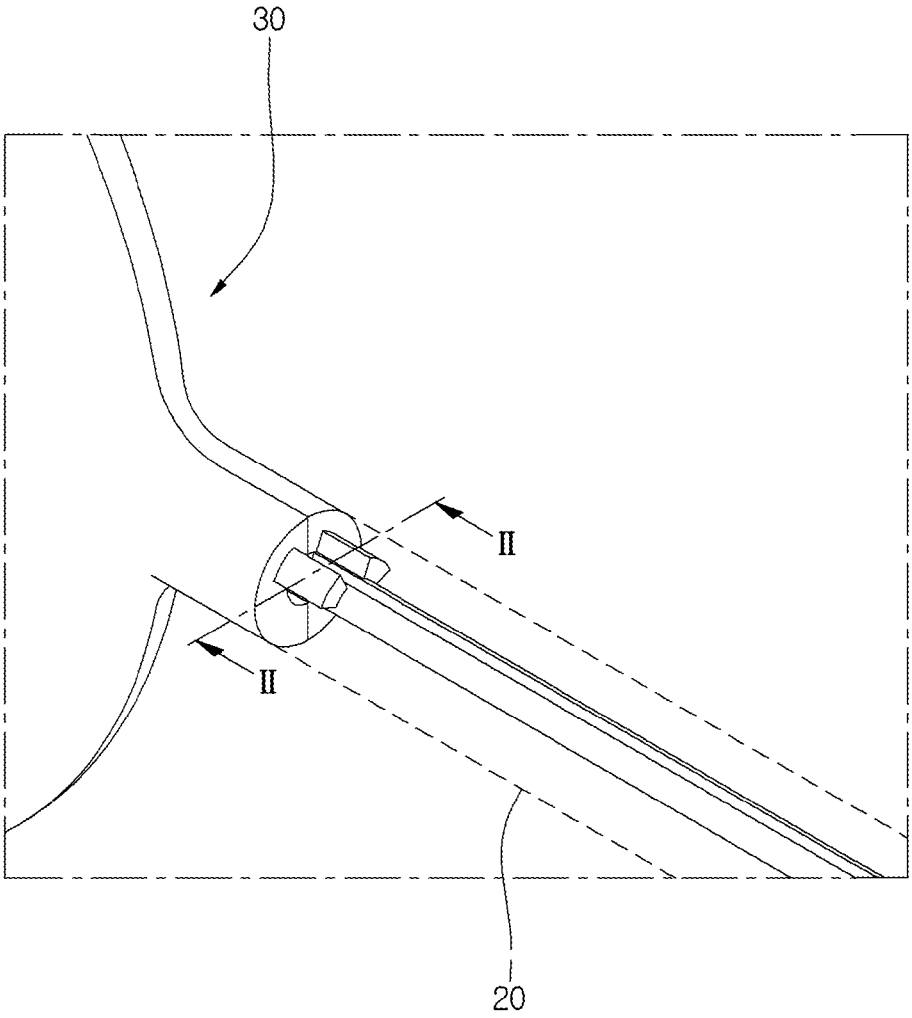
FIG. 20 is a partial perspective view illustrating a connection state of a sound output unit and a hook of a headset according to an embodiment of the present invention.
Figure 21:
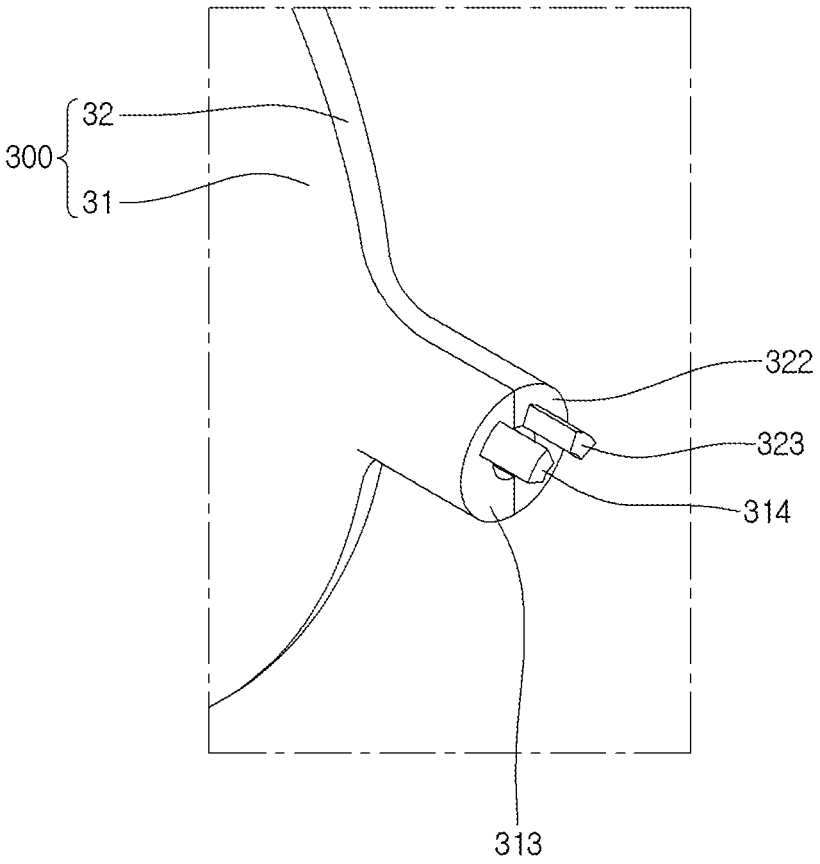
FIG. 21 is a partial perspective view illustrating a connection terminal of the sound output unit.
Figure 22:
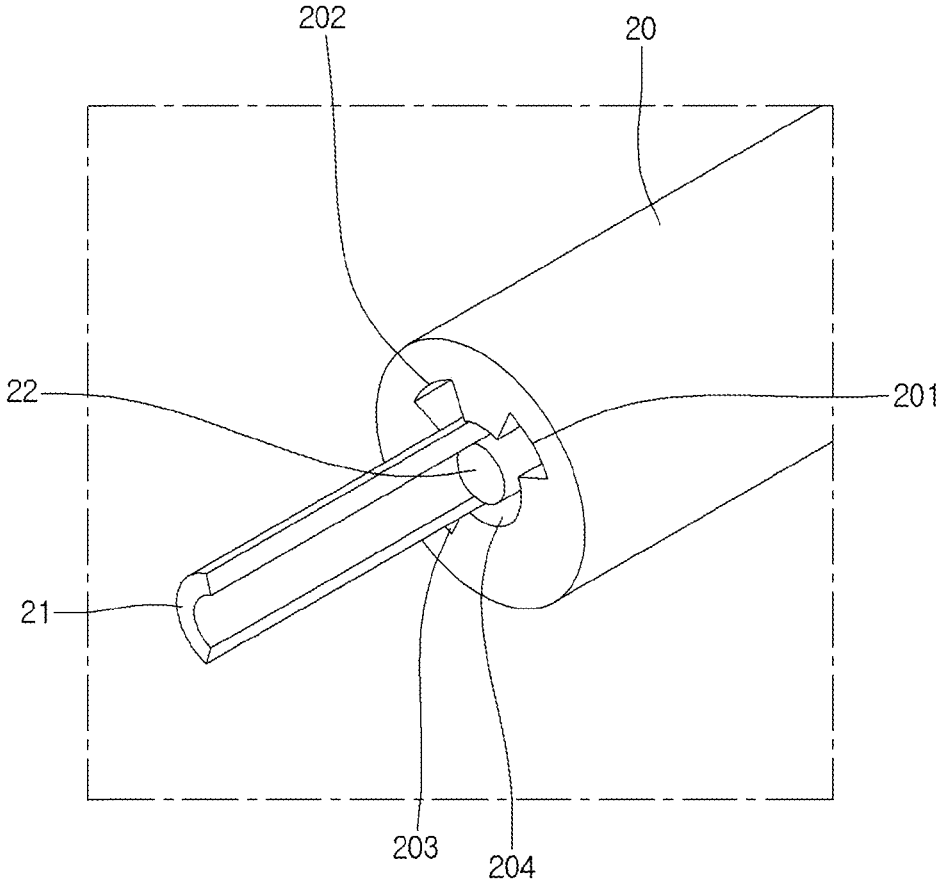
FIG. 22 is a perspective view illustrating an inner structure of the hook.

FIG. 20 is a partial perspective view illustrating a connection state of a sound output unit and a hook of a headset according to an embodiment of the present invention. FIG. 21 is a partial perspective view illustrating a connection terminal of the sound output unit. FIG. 22 is a perspective view illustrating an inner structure of the hook.

Referring to FIGS. 20 to 22, a connecting neck is formed at an end part of the frame 30 forming the appearance of the sound output unit 30, in more detail, an end part connecting to the hook 20.

In more detail, an inner neck 313 and an outer neck 322 are respectively formed at the end parts of an inner frame 31 and an outer frame 32 forming the frame 30. The inner neck 313 and the outer neck 322 are coupled to form one complete connecting neck. Then, an inner insertion protrusion 314 and an outer insertion protrusion 323 protrude respectively from the end parts of the inner neck 313 and the outer neck 322. The inner and outer insertion protrusions 314 and 323 are formed to be spaced a predetermined interval from each other in the circumferential direction of the connecting neck. Then, a hole where a wire is inserted is formed at the center of the connecting neck.

Additionally, a center hole 204 is formed at the inner center of the hook 20 and a plurality of insertion grooves recessed a predetermined depth from the edge of the center hole 204 in the radial direction are formed.

In more detail, a flexible substrate 21 and an elastic member 22, for example, a rubber material, are received in the center hole 204. Then, the plurality of insertion grooves may include a first insertion groove 201, a second insertion groove 202, and a third insertion groove 203. The number of grooves is greater by one than the number of insertion protrusions. Then, the first to third insertions grooves are recessed in the same form as the section of the insertion protrusion.

According to such a structure, as the inner insertion protrusion 314 and the outer insertion protrusion 323 are inserted into two adjacent insertion grooves among the first to third insertion grooves, the sound output unit 30 may be connected to the hook 20. Then, the flexible substrate 21 may be connected to the main circuit board 40 mounted in the sound output unit 30 and the end part of the elastic member 22 is fixed at the inner side of the sound output unit 30.

Figure 23:
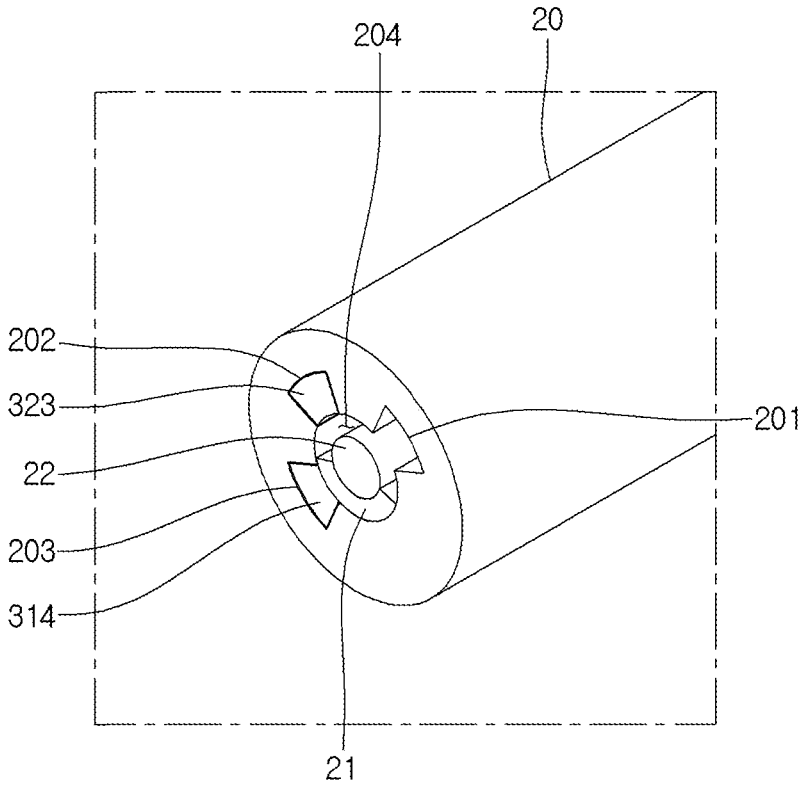
FIG. 23 is a sectional view taken along a line II-II of FIG. 20 when a pair of sound output units facing each other.

FIG. 23 is a sectional view taken along a line II-II when a pair of sound output units face each other. The inner neck 314 is inserted into the third insertion groove 203 and the outer neck 323 is inserted into the second insertion groove 202.

Figure 24:
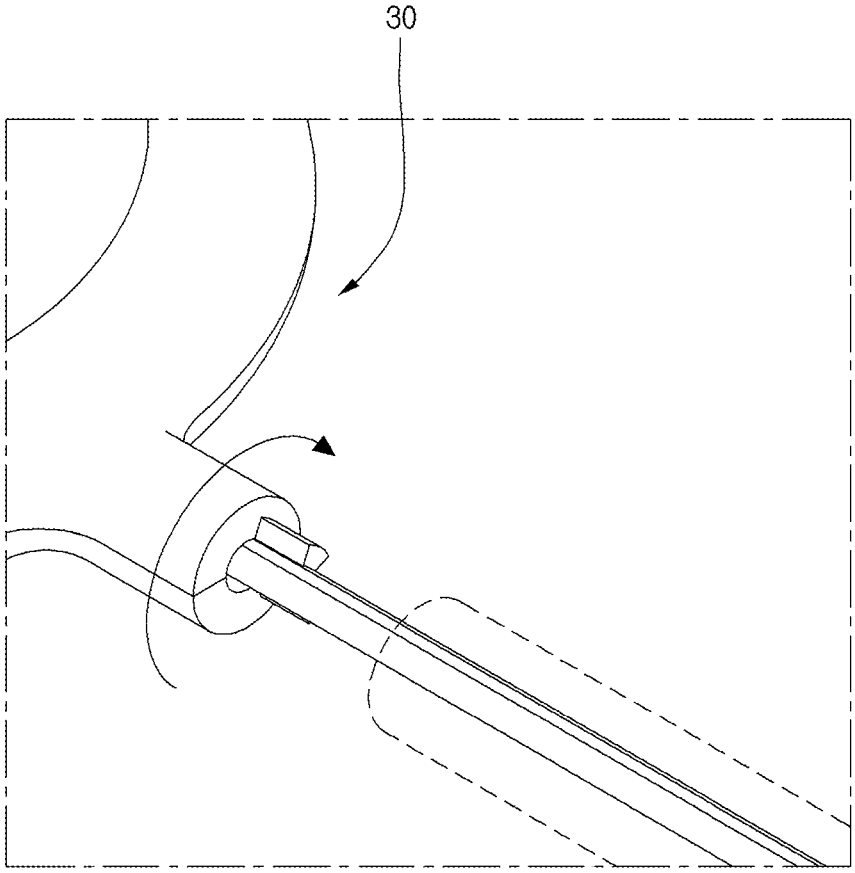
FIG. 24 is a view when a sound output unit rotates to face up.
Figure 25:
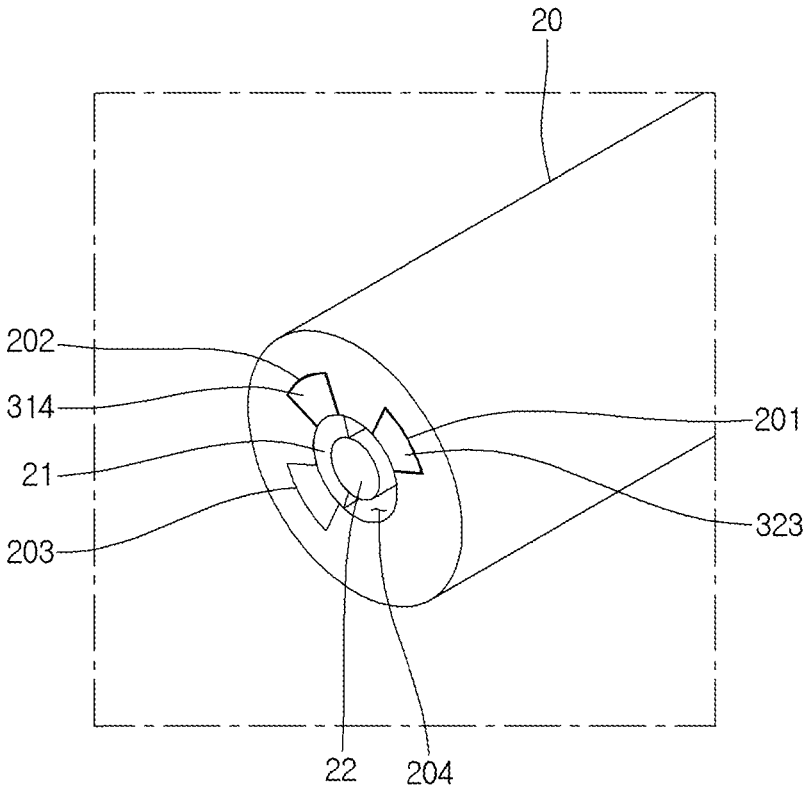
FIG. 25 is a sectional view taken along a line II-II of FIG. 18 when a sound output unit rotates.

FIG. 24 is a view when a sound output unit rotates to face the top. FIG. 25 is a sectional view taken along a line II-II of FIG. 18 when a sound output unit rotates.

Referring to FIGS. 24 and 25, the sound output unit 30 is rotatable by an angle corresponding to an interval between adjacent grooves. In this embodiment, 90° rotation will be described as an example.

In more detail, in order to rotate the sound output unit 30, the insertion protrusions are separated from the insertion grooves by pulling the sound output unit 30. In this state, the insertion protrusions are respectively inserted into the insertion grooves by rotating the sound output unit 30 by 90°. When the hand holding the sound output unit 30 is released, the insertion protrusions are respectively inserted into the insertion grooves by the restoring force of the elastic member 22.

In more detail, the inner insertions protrusion 314 inserted into the third insertion groove 203 is inserted into the second insertion groove 202. The outer insertion protrusion 323 inserted into the second insertion groove 202 is inserted into the first insertion groove 201. Then, the sound output unit 30 is fixed at the hook 20 as rotated by 90° from its original state.

Figure 26:
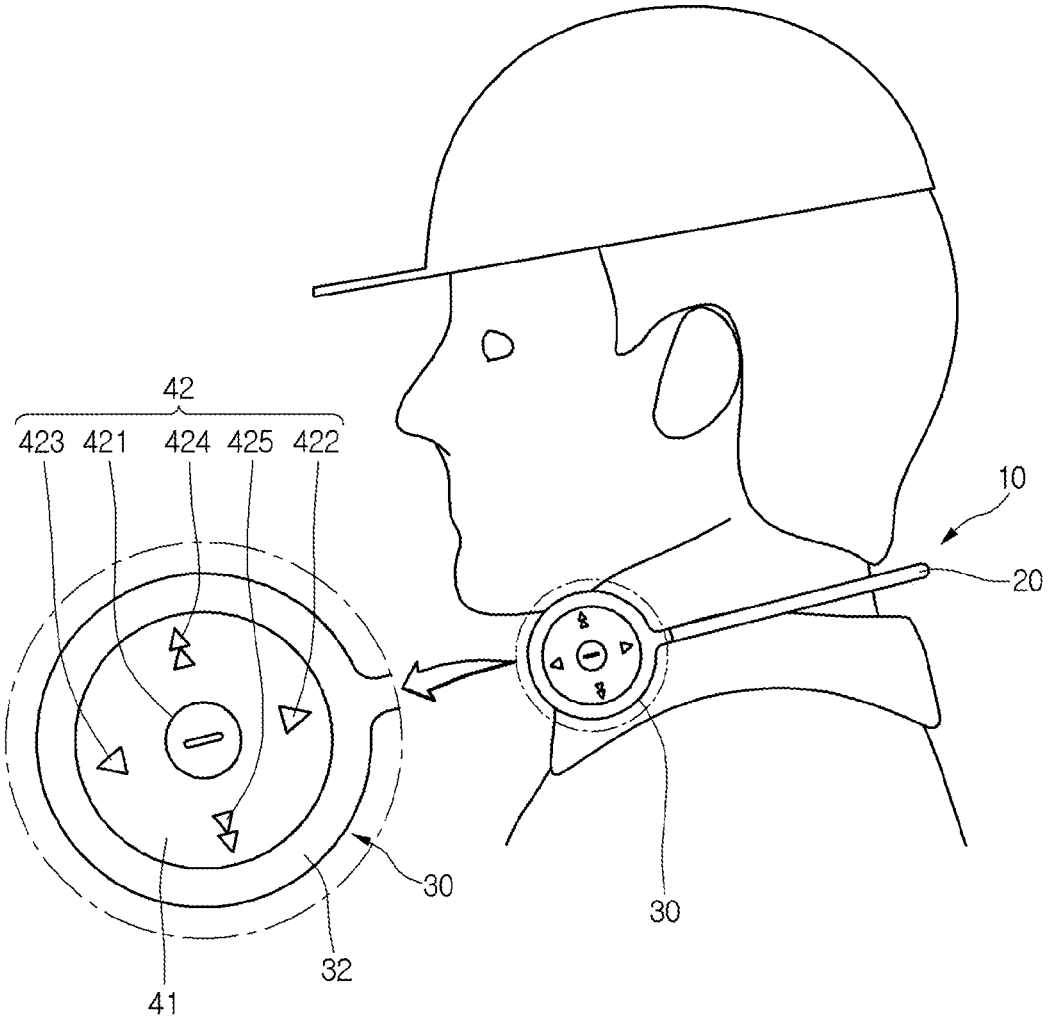
FIG. 26 is view when a hook of a headset is worn on the back of a user's neck according to an embodiment of the present invention.
Figure 27:
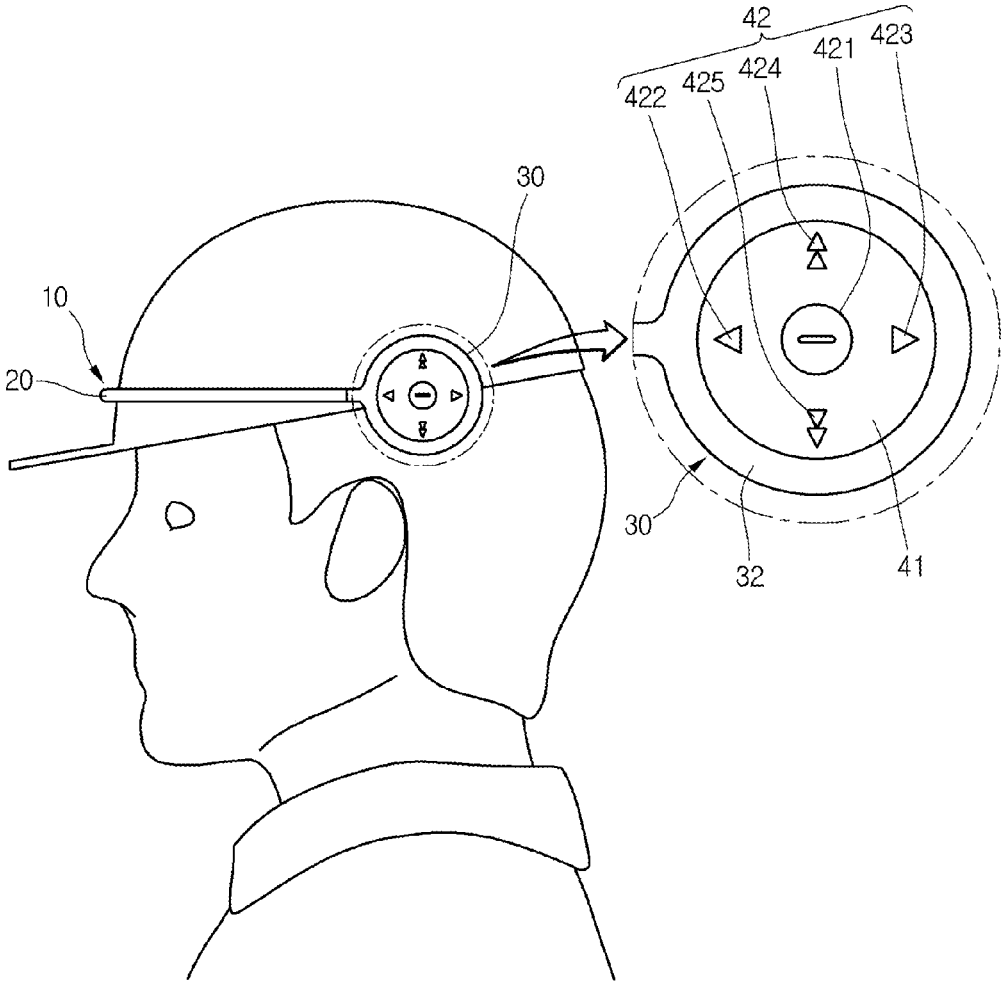
FIG. 27 is view when a hook of a headset is worn on the front of a user's face according to an embodiment of the present invention.

FIG. 26 is a view when a hook of a headset is worn on the back of the user's neck. FIG. 27 is a view when a hook of a headset is worn on the front of the user's face.

Referring to FIG. 26, a user may wear the headset 10 on the neck in order to allow the sound output unit 30 not to contact the ear. At this point, a button part 40 is formed at the outer side of the sound output unit 30.

In more detail, as mentioned above, the button part 42 may include a power button 421, a volume up button 422, a volume down button 423, a forward search button 424, and a backward search button 425.

The volume up button 422 is a button for increasing volume and may be formed at the upper edge of the cover plate 41 in order to improve user's recognition. Also, the volume down button 423 may be formed at the lower edge of the cover plate 41 corresponding to the opposite of the volume up button 422.

Additionally, the forward search button 424 and the backward search button 425 are buttons for searching for the next/previous radio frequency or song and the forward search button 424 may be disposed at the front edge of the cover plate 41. On the contrary, the backward search button 424 may be disposed at the rear edge of the cover plate 41. Herein, the positions of the buttons, that is, the back and forth or up and down directions, are set based on when the headset 10 is worn on a user as shown in FIG. 24.

Moreover, as shown in FIG. 27, a user connects the sound output unit 30 of the headset 10 to the lower end of the cap M and the hook 20 may be positioned at the front of the cap M. In this case, the positions of buttons forming the button part 42 rotate 180°. Then, a user may manipulate each button wrongly sometimes.

For example, as shown in FIG. 25, while a user wears the headset 10, the volume up button 422 is positioned at the lower part and the volume down button 423 is positioned at the upper part. Then, the forward search button 424 is positioned at the rear part and the backward search button 425 is positioned at the front part.

In this state, a user may unintentionally push a button at the top in order to push the volume up button 422 or may unintentionally push a button at the front in order to push the forward search button 424. Then, a command opposite to an intended command may be inputted.

In order to resolve such an issue, a gyro sensor is mounted in the sound output unit 30, so that a button manipulation may be made based on a user all the time regardless of a wearing state of the headset 10.

In more detail, the gyro sensor may detect a state of the sound output unit 30, that is, a normal state or a state in which the sound output unit 30 rotates 180°, and may change a control program in order to switch functions of the buttons according to a detection result.

For example, as shown in FIG. 27, even when the button part of the sound output unit 30 rotates 180°, the volume down button 423 position-switched to the upper may serve as a volume up button function and the forward search button 424 position-switched to the rear may serve as a backward search button function. Then, since a user manipulates the button part 42 according to a user's recognition state regardless of wearing a headset, a wrong command input may not occur. That is, the gyro sensor may be used as a means for switching a function of the button part 42.

Figure 28:
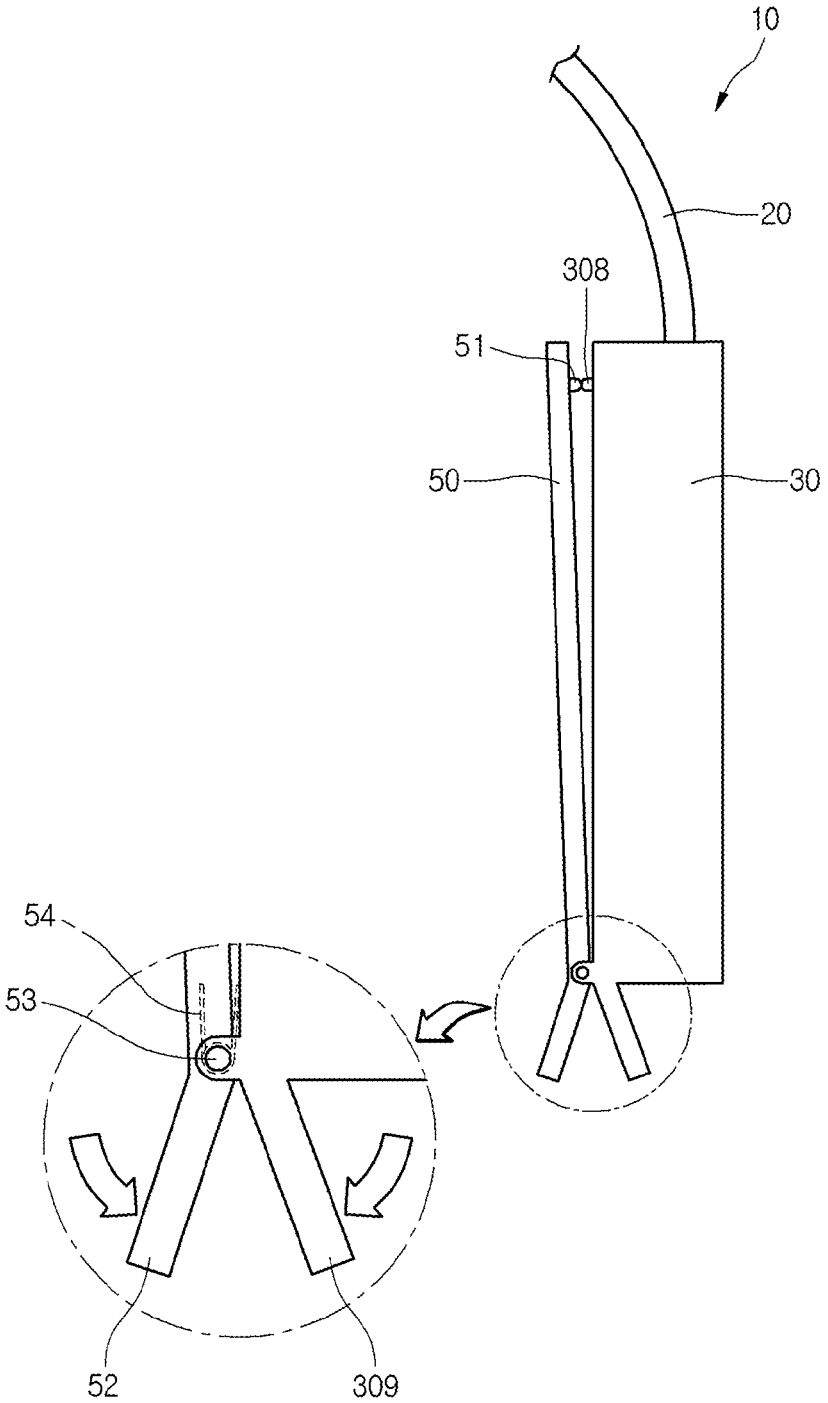
FIGS. 28 and 29 are views illustrating a clipping module according to another embodiment of the present invention.
Figure 29:
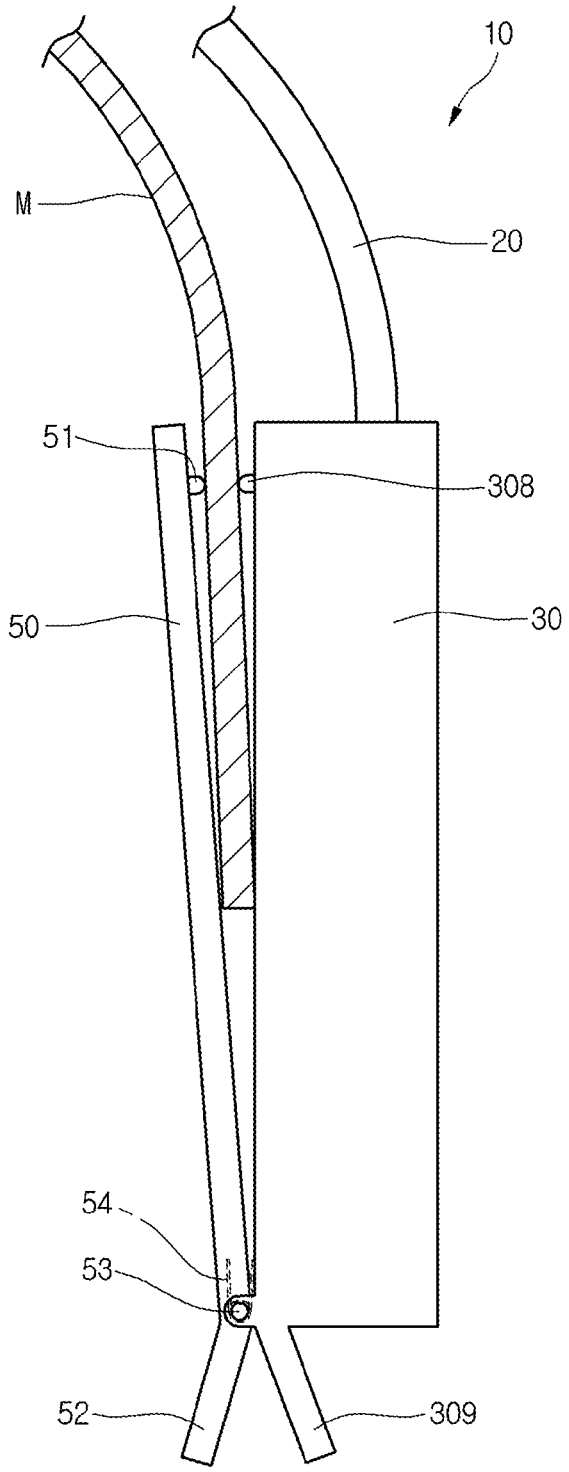

FIGS. 28 and 29 are views illustrating a clipping module according to another embodiment of the present invention.

Referring to FIGS. 28 and 29, in relation to a clipping module according to this embodiment, the fixing clip 50 is rotatably mounted on the sound output unit 30 and contact terminals 51 and 308 may be respectively formed at the fixing clip 50 and the sound output unit 30. That is, the clipping module according to this embodiment is provided in a pliers form.

In more detail, the fixing clip 50 may be formed in a disc form like the previous embodiment and a grip part 52 may extend from one side edge of the fixing clip 50. Then, a grip part 309 may extend from one side edge of the sound output unit 38 and portions where the grip parts 52 and 309 are formed may be connected by a hinge 53. Then, an elastic member such as a torsion spring 54 is mounted on the hinge 53 so that the fixing clip 50 adheres to the sound output unit 30 all the time. Then, when a user pushes the grip parts 52 and 309 by the hands, the fixing clip 50 rotates on the basis of the hinge 53 and becomes away from the sound output unit 30. Then, when the hand is released from the grip parts 52 and 309, the fixing clip 50 returns to its original position by the restoring force of the torsion spring 54.

Then, the contact terminals 51 and 308 may be formed at the surface where the fixing clip 50 and the sound output unit 30 face each other. In more detail, the contact terminal 51 may be formed at the end part of the fixing clip 50 corresponding to the opposite of the hinge 53 and the contact terminal 308 may be formed at the edge of the sound output unit 30 corresponding to the position of the contact terminal 51. By such a structure, the contact terminals 51 and 308 maintain a contacted state when the grip parts 52 and 309 are not manipulated.

Moreover, in order to couple the sound output unit 30 to the cap M, a user holds the grip parts 52 and 309 by the hand and spreads the fixing clip 50, so that the lower part of the cap M is inserted between the fixing clip 50 and the sound output unit 30.

While the sound output unit 30 is mounted on the cap M, the contact terminals 51 and 308 become spaced apart from each other. When the contact terminals 51 and 308 are separated, a control unit of a terminal may be programmed to recognize that the sound output unit 30 is mounted on the cap M. Then, the control unit of the terminal may automatically lower the volume of sound. The reason is that when the sound output unit 30 is mounted on a cap, since a speaker hole is close to a user's ear, the volume in a state of being worn on the neck is maintained, this may damage the ear's eardrum.

Of course, in a clipping module according to a previous embodiment, when it is detected that the sound output unit 30 is mounted on a cap, the volume is automatically decreased and such a detection function may be performed by the sensor module 43.

Additionally, the above-mentioned clipping module is equipped only at the sound output unit 30 at one side but the present invention is not limited thereto. That is, the clipping modules may be respectively equipped at the left and right sound output units 30.

Figure 30:
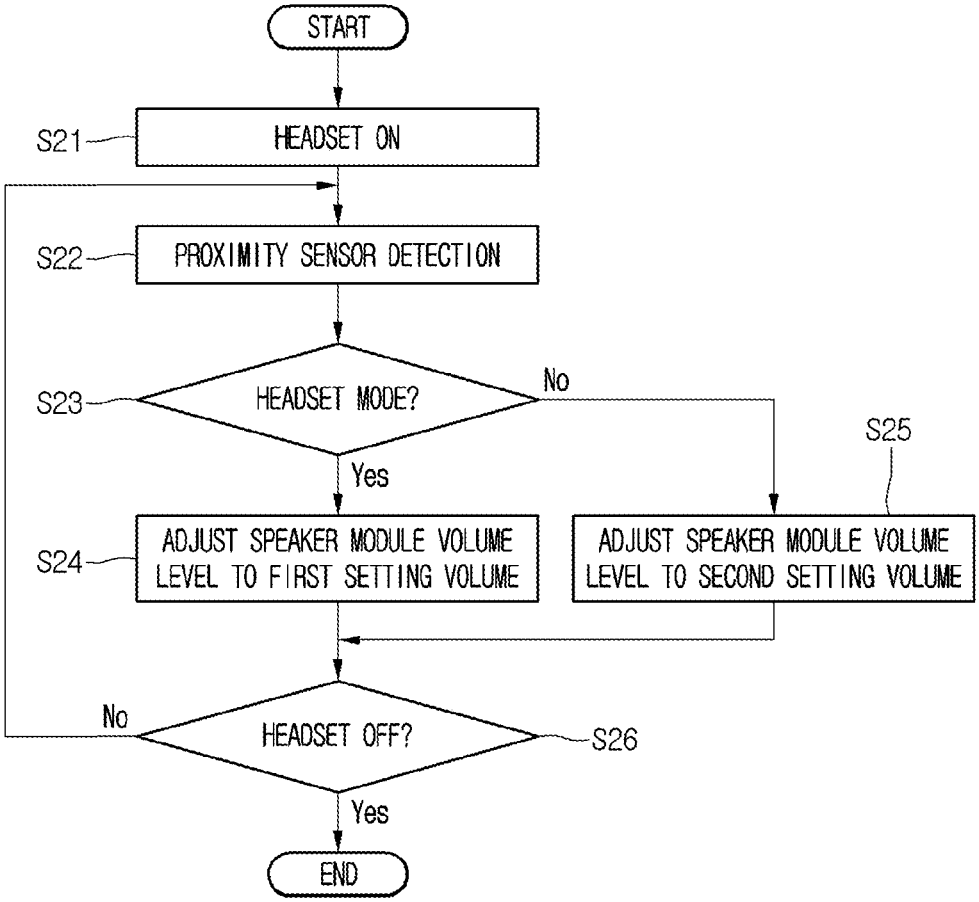
FIG. 30 is a flowchart illustrating a volume control method when a headset is worn according to an embodiment of the present invention.

FIG. 30 is a flowchart illustrating a volume control method when a headset is worn according to an embodiment of the present invention.

Referring to FIG. 30, when the headset 10 is turned on by a user in operation S21, the sensor module 43 in the sound output unit 30, that is, a proximity sensor, operates and detects in which state the sound output unit 30 is disposed in operation S22.

In more detail, whether the sound output unit 30 is mounted on a cap by a clipping module, whether the sound output unit 30 is close to the user's ear, or whether the headset 10 is worn on the user's neck so that the sound output unit 30 is disposed in front of the user's chest to face up may be detected by the proximity sensor.

Here, a case in which the sound output unit 30 is placed in front of the user's chest may be defined as a neckband mode and a case in which the sound output unit 30 is mounted on a cap or adheres to the user's ear may be defined as a headset mode.

In more detail, the proximity sensor determines whether the sound output unit 30 is in a headset mode in operation S23 and when it is determined that the sound output unit 30 is in the headset mode, a volume level of the speaker module 39 is adjusted to a first setting volume in operation S24. However, when it is determined that the sound output unit 30 is in a neckband mode, a volume level of the speaker module 39 is adjusted to a second setting volume in operation S25. The second setting volume may be set higher than the first setting volume. Then, in the neckband mode, the sound outputted from the speaker module 39 may be clear to the user's ear and in the headset mode, the sound is outputted relatively smaller so that the user's eardrum may be protected.

Additionally, if a headset is turned off while a user listens to music in operation S26, the control process is terminated. If a turn-off command is not inputted, the proximity sensor continuously detects a wearing state of the sound output unit 30.

Figure 31:
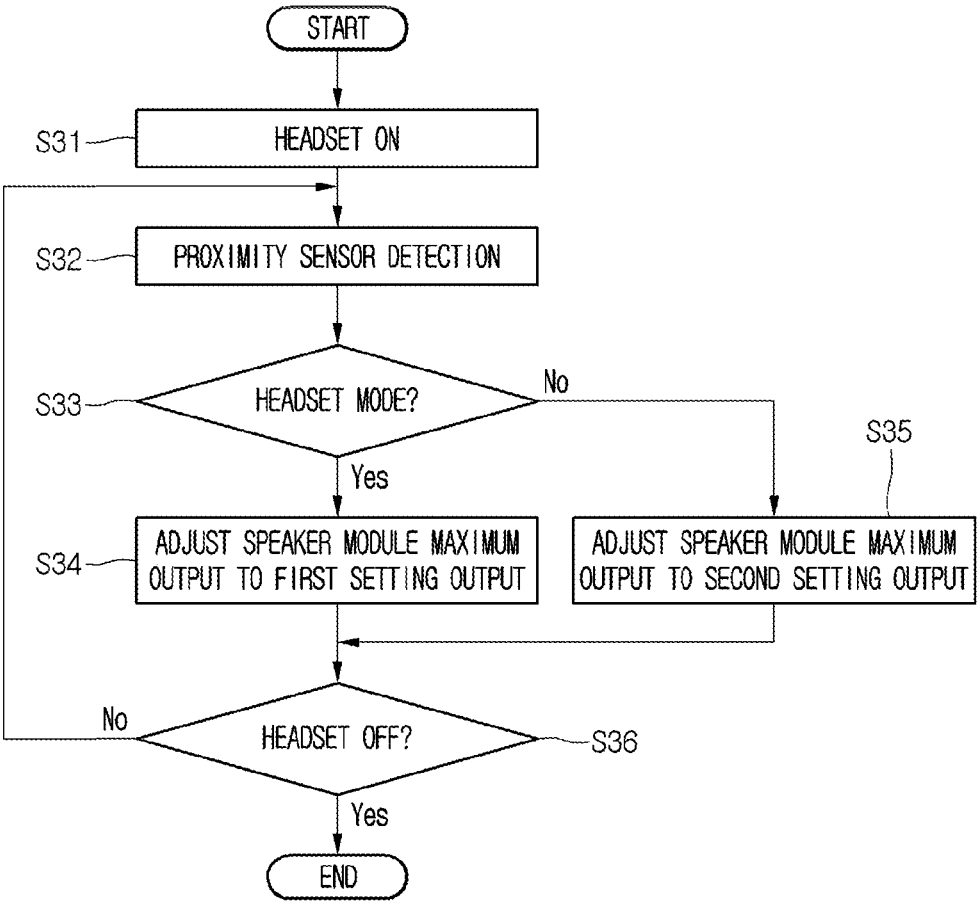
FIG. 31 is a flowchart illustrating a volume control method when a headset is worn according to another embodiment of the present invention.

FIG. 31 is a flowchart illustrating a volume control method when a headset is worn according to another embodiment of the present invention.

Referring to FIG. 31, according to a wearing state of the headset 30, the intensity of sound outputted from the sound output unit 30 may be adjusted through volume control. As another method, the maximum output of the sound output unit 30 may be controlled to achieve the same purpose.

In more detail, when the headset 10 is turned on in operation S31, the proximity sensor detects a wearing state of the sound output unit 30 in operations S32 and S33. Defining the wearing state as the headset mode and the neckband mode is the same as described in the embodiment of FIG. 30. However, there is a difference in controlling a volume level and a maximum output level of the sound output unit 30.

In more detail, when it is determined that a wearing state of the sound output unit 30 is in a headset mode, the maximum output of the speaker module 39 is adjusted to a first setting output and when it is determined that a wearing state of the sound output unit 30 is in a neckband mode, the maximum output of the speaker module 39 is adjusted to a second setting output. Then, the second setting output may be set higher than the first setting output.

The maximum output of the sound output unit 30 in the headset mode is set lower than the maximum output of the sound output unit 30 in the neckband mode. Therefore, a level of the maximum volume that a user sets is limited to protect the user's eardrum. That is, even when a user increases the volume to maximum in the headset mode, an output of the speaker module 39 is limited so that a level of damaging the user's eardrum is limited to a lower level.

In the embodiment of adjusting a volume level, when a user wears the headset 10 in close to the user's ear in a headset mode, a volume level of an appropriate level is set to allow a user conveniently listen to sound. In this embodiment, a speaker output is set to be limited so that the maximum volume level that a user increases is limited in a headset mode. Therefore, according to this embodiment, regardless of a wearing mode of the headset 10, the same level of volume may be set as a default value. Then, after the headset 10 is worn, each time volume adjustment is made by a user's manipulation, a volume up level is limited.

Figure 32:
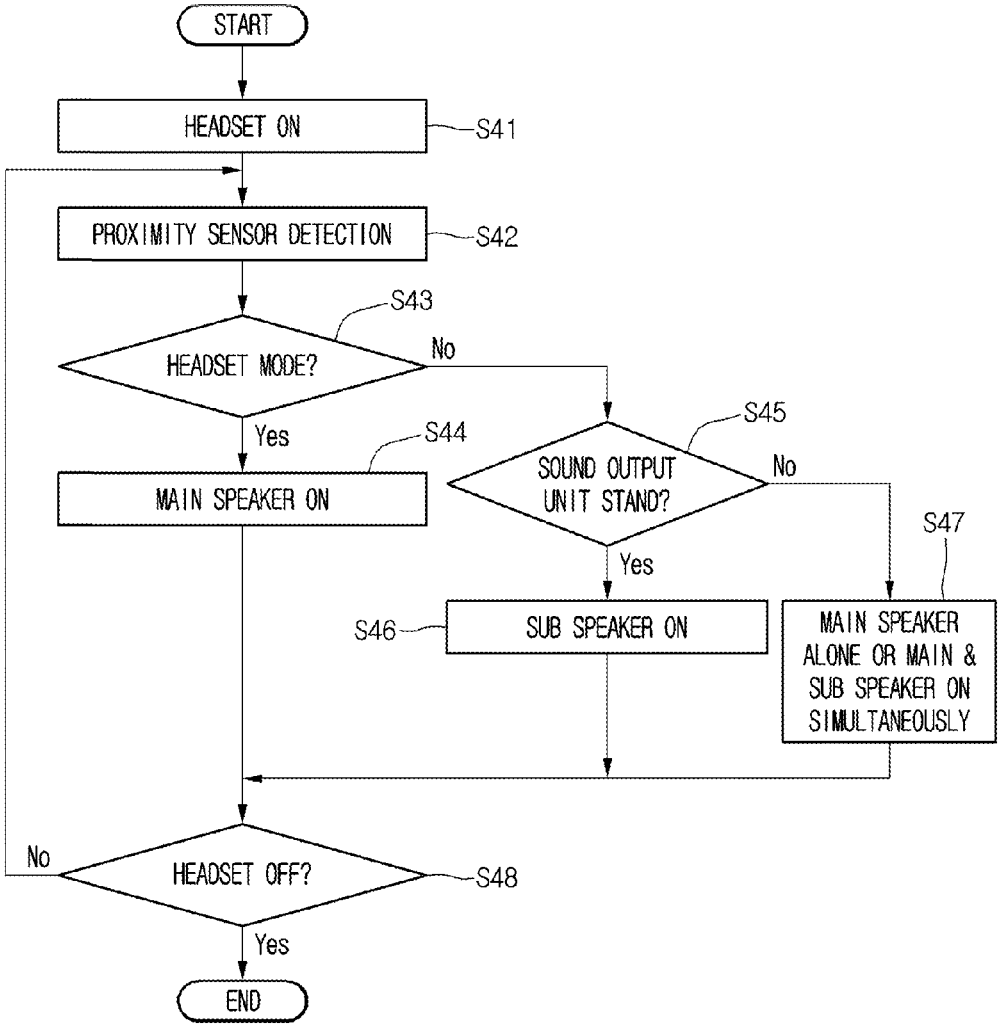
FIG. 32 is a flowchart illustrating a control method of a speaker module when a headset is worn according to an embodiment of the present invention.

FIG. 32 is a flowchart illustrating a control method of a speaker module when a headset is worn according to an embodiment of the present invention.

Referring to FIG. 32, in this embodiment, according to a wearing mode of a headset that a proximity sensor detects, on/off of a speaker is controlled.

As described above, one or a plurality of speaker modules may be mounted on each inside of the sound output units 30 of the headset 10 and a control method suggested in this embodiment is based on that a plurality of speakers are mounted in one sound output unit 30.

This embodiment is described based on the assumption that a main speaker and a sub speaker are separately mounted on the rear sides of the main speaker hole 361 and the sub speaker hole 312.

First, when the headset 10 is turned on in operation S41, the proximity sensor detects and determines a wearing mode of a headset in operations S42 and S43. Then, when it is determined that the detected wearing mode is a headset mode, only the main speaker is turned on in operation S43.

On the other hand, when the headset 10 is in a neckband mode instead of a headset mode, it is determined whether the sound output unit 30 stands in operation S45. Herein, whether the sound output unit 30 stands or whether the main speaker hole 365 lies facing up may be detected by a gyro sensor built in the sound output unit 30.

In more detail, when a result detected by the gyro sensor is that the sound output unit 30 stands, only the sub speaker may be turned on. On the other hand, when the sound output unit 30 lies, only the main speaker is turned on or both the main speaker and the sub speaker are turned on in operation S47. The number of speakers turned on when the sound output unit 30 lies may be set by a user in advance.

Moreover, while sound is outputted from a speaker turned on according to the wearing mode, if the headset 10 is turned off, the control method is terminated. Until the headset 10 is turned off, the proximity sensor continuously detects a wearing mode and speaker on/off control is performed according thereto.

Moreover, the headset 10 according to an embodiment of the present invention may have the following functions.

First, when it is detected that the sound output unit 30 is mounted on a cap, a radio frequency that a user listens most is automatically selected, so that a radio broadcast of a corresponding frequency is automatically turned on.

Second, when it is detected that the sound output unit 30 is mounted on a cap, a cap dedicated sound equalizer may be set. For example, since a user wears a cap outdoors typically, assuming the situation of outdoor activities, an equalizer setting increasing the base sound may be possible.

Third, with a plurality of speaker modules built in the hook 2220 of the headset 10, according to a user's selection, a user may feel a 3D sound, for example, 5.1 channel sound effect.

Also, the above-mentioned user interface may be executable through a manipulation of an application installed at a smartphone wirelessly connected to the headset.

A headset according to an embodiment of the present invention forming the above configuration may have the following effects.

First, since a headset is detachable from a cap, even when taking off the cap, since a typical headphone function is performed, a user may listen to music and the cap may be washed at any time.

Second, since a sound output unit of a headset is rotatable, sound is outputted toward the user's ears regardless of a wearing state, so that sound directivity may be obtained.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A headset comprising:

a hook hung on a user's neck;

a pair of sound output units connected to both end parts of the hook; and a clipping module provided to at least one of the sound output units, the clipping module configured to allow the at least one sound output unit to be detachably coupled to a cap worn by the user, wherein each of the sound output units comprises:

a case;

a frame surrounding an outer peripheral surface of the case and including a first speaker hole formed at an edge portion; and a speaker module installed inside the case, wherein the clipping module comprises:

a guide sleeve extending from an inside of the case;

a plurality of hook shoulders extending in a length direction of the guide sleeve at an inner peripheral surface of the guide sleeve and arranged in a circumferential direction of the guide sleeve;

a fixing clip disposed at an inner surface of the case facing the user's ear;

a clip button penetrating the fixing clip to be inserted into the guide sleeve and moving with the fixing clip integrally to allow the fixing clip to be selectively in close contact with the inner surface of the case;

a stopper selectively hooked by the hook shoulder and pushing the clip button when separated from the hook shoulder; and a spring in close contact one surface of the stopper and having an elastic force for pushing the stopper.

2. The headset according to claim 1, wherein the clip button comprises:

a head part including a second speaker hole;

a hollow body part extending from the other surface of the head part and having a narrower diameter as it approaches an end part;

a plurality of push protrusions protruding from the end part of the body part and arranged spaced a predetermined interval from each other in a circumferential direction of the body part; and a plurality of guide protrusions protruding from an outer peripheral surface of the body part and arranged spaced a predetermined interval from each other in the circumferential direction of the body part.

3. The headset according to claim 2, wherein the plurality of guide projections are formed at points corresponding to the plurality of push protrusions; and a center of the plurality of guide protrusions and a center of the push protrusions are disposed on the same line.

4. The headset according to claim 2, wherein the guide sleeve extends from an inner surface of the case, wherein the guide sleeve further comprises:

a sitting projection extending in a center direction of the guide sleeve from a bottom surface of the guide sleeve; and a plurality of guide ribs protruding from an inner peripheral surface of the guide sleeve, extending in a length direction of the guide sleeve, and arranged spaced a predetermined interval from each other in a circumferential direction of the guide sleeve.

5. The headset according to claim 4, wherein guide grooves are formed between the adjacent guide ribs; and the guide protrusions are inserted into the guide grooves to guide a movement of the clip button.

6. The headset according to claim 5, wherein the hook shoulder is formed between the adjacent guide ribs; and the guide groove and the hook shoulder are alternately formed in the circumferential direction of the guide sleeve.

7. The headset according to claim 6, wherein an inclined surface inclined at a predetermined angle is defined at an end part of the guide rib; and the hook shoulder is inclined to be disposed on the same line as the inclined surface of the guide rib.

8. The headset according to claim 7, wherein the stopper comprises:

a base having one surface where the spring is seated;

a stopper body extending from the other surface of the base; and a plurality of hook protrusions protruding from an outer peripheral surface of the stopper body in a radial direction and moving along the guide groove.

9. The headset according to claim 8, wherein each of the plurality of hook protrusions forms a push surface selectively contacting the push protrusion; and the push surface is inclined at an angle to match a shape of the inclined surface of the guide rib and the hook shoulder.

10. The headset according to claim 9, wherein when the clip button is pushed, the hook protrusion is pushed by the push protrusion and moves along the guide groove;

the spring is compressed; and when a force for pushing the clip button is removed at a point where the hook protrusion is out of the guide groove, the hook protrusion rotates along the inclined surface of the guide rib by the restoring force of the spring and is seated on the hook shoulder.

11. The headset according to claim 10, wherein the clip button is retreated to a point where the hook shoulder is seated on the hook shoulder; and the clip button is fixed by a frictional force between the outer peripheral surface of the clip button and the sitting projection at a point where the hook protrusion is seated at the hook shoulder.

12. The headset according to 11, wherein when the clip button is pushed again, the hook protrusion is pushed by the push protrusion and separated from the sitting projection;

the spring is compressed;

when a force for pushing the clip button is removed at a point where the hook protrusion is out of the guide rib, the hook protrusion rotates along the inclined surface of the guide rib by the restoring force of the spring and is inserted into the guide groove; and the clip button moves as pushed by the hook protrusion and is retreated until the guide protrusion contacts the sitting projection.

13. The headset according to claim 12, wherein the elastic force of the spring is greater than a frictional force between the outer peripheral surface of the clip button and the sitting projection.

14. The headset according to claim 2, wherein the sound output unit is rotatable at a predetermined angle from the hook and is withdrawable in a direction away from the end part of the hook.

15. The headset according to claim 14, wherein the sound output unit is rotatable from a first position where the second speaker holes stand to face each other to a second position where the second speaker holes face the same direction or inversely rotatable from the second position to the first position.

16. The headset according to claim 15, wherein a rotation angle from the first position to the second position is 90°.

17. The headset according to claim 14, wherein the sound output unit comprises:

a connecting neck extending from an edge of the frame; and a plurality of insertion protrusions protruding from an end part of the connecting neck, wherein the plurality of insertion protrusions are arranged spaced at a predetermined angle from each other in a circumferential direction of the connecting neck.

18. The headset according to claim 17, wherein the hook comprises:

a center hole formed at an inner center; and a plurality of insertion holes extending from an edge of the center hole radially and including a plurality of insertion holes in which the plurality of insertion protrusions are respectively inserted, wherein the plurality of insertion holes are arranged spaced at a predetermined angle from each other in a circumferential direction of the center hole.

19. The headset according to claim 18, wherein the number of the plurality of insertion protrusions is less than the number of the plurality of insertion holes.

20. The headset according to claim 18, further comprising:

an elastic member inserted into the hook through the center hole and having both end parts connected to the sound output unit; and a flexible substrate inserted into the hook through the center hole and having an end part electrically connected to a circuit component installed in the sound output unit.

21. The headset according to claim 18, wherein when the plurality of insertion protrusions are inserted into the plurality of insertion holes, an end part of the connecting neck contacts an end part of the hook;

when the sound output unit is pulled in a direction in which the end part of the connecting neck is separated from the end part of the hook, the flexible substrate and the elastic member extend a predetermined length; and the plurality of insertion protrusions are separated from the plurality of insertion holes.

22. The headset according to claim 21, wherein when a force for pulling the sound output unit is removed, after the sound output unit is rotated in a state where the plurality of insertion protrusions are separated from the plurality of insertion holes, the plurality of insertion protrusions are inserted into other insertion holes adjacent to the insertion holes that the plurality of insertion protrusions were previously inserted, and wherein the flexible substrate and the elastic member return to their original positions.

23. The headset according to claim 2, wherein sound oriented directions of the first speaker hole and the second speaker hole intersect each other.

24. The headset according to claim 2, wherein sound oriented directions of the first speaker hole and the second speaker hole intersect at 90°.

25. The headset according to claim 1, further comprising a sensor module mounted inside the sound output unit to detect whether the sound output unit is mounted on the user's cap or whether the sound output unit is positioned close to the user's ear, wherein the sensor module comprises an infrared sensor.

26. The headset according to claim 25, wherein when it is detected by the sensor module that the sound output unit is mounted at the user's cap or is positioned close to the user's ear, a volume of the speaker module is lowered to a setting level.

27. The headset according to claim 25, further comprising:

a circuit substrate where the speaker module and the sensor module are mounted; and a battery mounted in the sound output unit.

28. The headset according to claim 1, further comprising:

a cover plate mounted on an outer surface of the case to cover the circuit substrate; and a button part formed at an outer surface of the cover plate.

29. The headset according to claim 28, wherein the button part comprises:

a power button disposed at a center of the cover plate; and a sound adjustment button and a search button disposed in a circumferential direction at a point spaced from the power button.

30. The headset according to claim 29, wherein the sound adjustment button comprises:

a volume up button disposed at an upper part of the cover plate; and a volume down button disposed at a lower part of the cover plate, wherein the search button comprises:

a forward search button disposed at a front of the cover plate; and a backward search button disposed at a rear of the cover plate.

31. The headset according to claim 30, further comprising:

a gyro sensor mounted in the sound output unit to detect a rotation state of the sound output unit, wherein whether the hook is changed from one position of a rear of the user's head or a front of the user's cap to the other position is detected by the gyro sensor; and when a rotation of the sound output unit is detected by the gyro sensor, functions of the sound adjustment buttons and functions of the search buttons are respectively inverted.

32. The headset according to claim 1, further comprising a short range wireless communication module mounted in the sound output unit, wherein the short range wireless communication module includes a Bluetooth module.

33. The headset according to claim 25, wherein when it is detected by the sensor module that the sound output unit is mounted on the user's cap, a radio frequency that a user listen most is automatically selected and turned on.

34. The headset according to claim 25, wherein when it is detected by the sensor module that the sound output unit is mounted in the user's cap, a cap dedicated sound equalizer is set.

* * * * *